US005981891A

United States Patent [19]

Yamashita et al.

[11] Patent Number: 5,981,891

[45] Date of Patent: Nov. 9, 1999

[54] APPARATUS FOR SORTING SHEETS OR THE LIKE

[75] Inventors: Taichiro Yamashita, Tsuchiura; Takao Terayama, Ushikyu; Yasunori Hamada, Tsuchiura; Itsunori Utsumi, Owariasahi; Noriaki Hagiwara, Tsuchiura, all of Japan

[73] Assignee: Hitachi, Ltd., Tokyo, Japan

[21] Appl. No.: 08/819,090

[22] Filed: Mar. 18, 1997

[30] Foreign Application Priority Data

Mar. 19, 1996 [JP] Japan ..... 8-062480

[51] Int. Cl.[6] ..... B07C 5/00

[52] U.S. Cl. ..... 209/584; 209/900; 271/3.01; 271/3.14

[58] Field of Search ..... 209/552, 559, 209/562, 564, 583, 584, 900; 271/3.01, 3.12, 3.14

[56] References Cited

U.S. PATENT DOCUMENTS

| | | | |
|---|---|---|---|
| 4,388,994 | 6/1983 | Suda et al. | 209/900 X |
| 5,097,959 | 3/1992 | Tilles et al. . | |
| 5,119,954 | 6/1992 | Svyatsky et al. | 271/3.01 X |
| 5,346,072 | 9/1994 | Dian et al. | 209/584 |
| 5,353,938 | 10/1994 | LaGrange et al. . | |
| 5,363,971 | 11/1994 | Weeks et al. | 209/584 |
| 5,433,325 | 7/1995 | Levaro et al. | 209/900 X |

FOREIGN PATENT DOCUMENTS

| | | | |
|---|---|---|---|
| 0575032 | 12/1993 | European Pat. Off. . | |
| 51-105897 | 9/1976 | Japan . | |
| 1-113888 | 5/1989 | Japan . | |
| 5-342422 | 12/1993 | Japan . | |
| 9500097 | 3/1996 | Netherlands . | |
| 94/16829 | 8/1994 | WIPO | 209/584 |

*Primary Examiner*—Tuan N. Nguyen
*Attorney, Agent, or Firm*—Antonelli, Terry, Stout & Kraus, LLP

[57] ABSTRACT

A hopper for feeding documents also serves as a stacker for stacking therein documents in a generally upright position. When the fed documents or the once-stacked documents are to be fed to a singulation mechanism, the hopper or stacker is put into a feeding mode, and when the documents are to be stacked or sorted, the hopper or stacker is switched to a stacking mode. Such hoppers or stackers are arranged in a plurality of stages, and when each sorting is to be effected, addresses are read while changing the mode of each hopper or stacker to repeat the sorting, so that the documents are sequenced by a radix sort method.

17 Claims, 30 Drawing Sheets

APPARATUS FOR SORTING SHEETS OR THE LIKE

BACKGROUND OF THE INVENTION

This invention relates to an apparatus for sorting sheets or the like, and more particularly for sequencing randomly-arranged sheets or the like in a desired order.

A carrier route sequencing operation of mail for sequencing the volume of mail into a carrier route in accordance with addresses has required many hands, and with the increase of mail, an amount of labor for such sequencing operation has become very large, and therefore it has been desired to automate the operation. Japanese Patent Unexamined Publication No. 51-105897 (Document 1) discloses an apparatus for feeding and taking out sheets or the like, in which a sorting information provided on the sheets or the like such as mail is read, and the charged sheets or the like are sequenced in an order designated by the sorting information. The Document describes that in order to sequence the randomly-stacked sheets or the like, it is necessary to sequence the stacked sheets or the like several times, and therefore a stacking section is provided just above a feeder section and is opened at its bottom to cause the stacked sheets or the like to fall on the feeder section to be conveyed onto the feeder section, and by doing so, the sorting (sequencing) is repeatedly effected to sequence the charged sheets or the like in an order designated by the sorting information.

Card sequencing apparatuses are disclosed in Japanese Patent Unexamined Publication Nos. 5-342422 (Document 2) and 1-113888 (Document 3). Stacked cards are once sorted into a plurality of stacker-feeder sections, and then are sequentially taken out therefrom to be arranged in a predetermined order or sequence. In this technique, the stacker-feeder section is provided for each sorting class, and each stacker-feeder section must be provided with discharge rollers for separating and discharging the once stacked cards.

In the above Document 1, mail once stacked in the stacker are caused to fall on the feeder section, so that an impact produced thereby can disturb the mail in posture. As a result there is a problem that the mail are arranged obliquely when again separated by a singulator mechanism, and in the worst case, the mail get out of the sorting machine when falling.

In the above Document 2, the sorted cards are merely arranged according to sorting classes, and an order or sequence in such arrangement is not taken into consideration. In the technique of the above Document 3, cards are handled in thousands (1,000) such that the cards having the same number in hundred's place are stacked in respective temporary stackers, and are grasped by ten sets of impellers having ten grasping portions to be subjected to sequencing. Therefore, there is a problem that when a number of cards increases, the handling speed is lowered, and that when speed is tried to increase a number of the temporary stackers as well as a number of the impellers must be increased. In the technique of the above Documents 2 and 3, there is a further problem that each stacker-feeder section provided for each sorting class requires discharge rollers for discharging the cards, and is complicated in construction, and the size of the apparatus is increased.

SUMMARY OF THE INVENTION

It is an object of the invention to provide an apparatus for sorting sheets or the like, which is capable of sequencing the stacked sheets or the like without making them fall.

BRIEF DESCRIPTION OF THE DRAWINGS

FIG. 4 is an illustration showing one example of a sequencing operation for sheets or the like;

DESCRIPTION OF THE PREFERRED EMBODIMENTS

Figure 1:
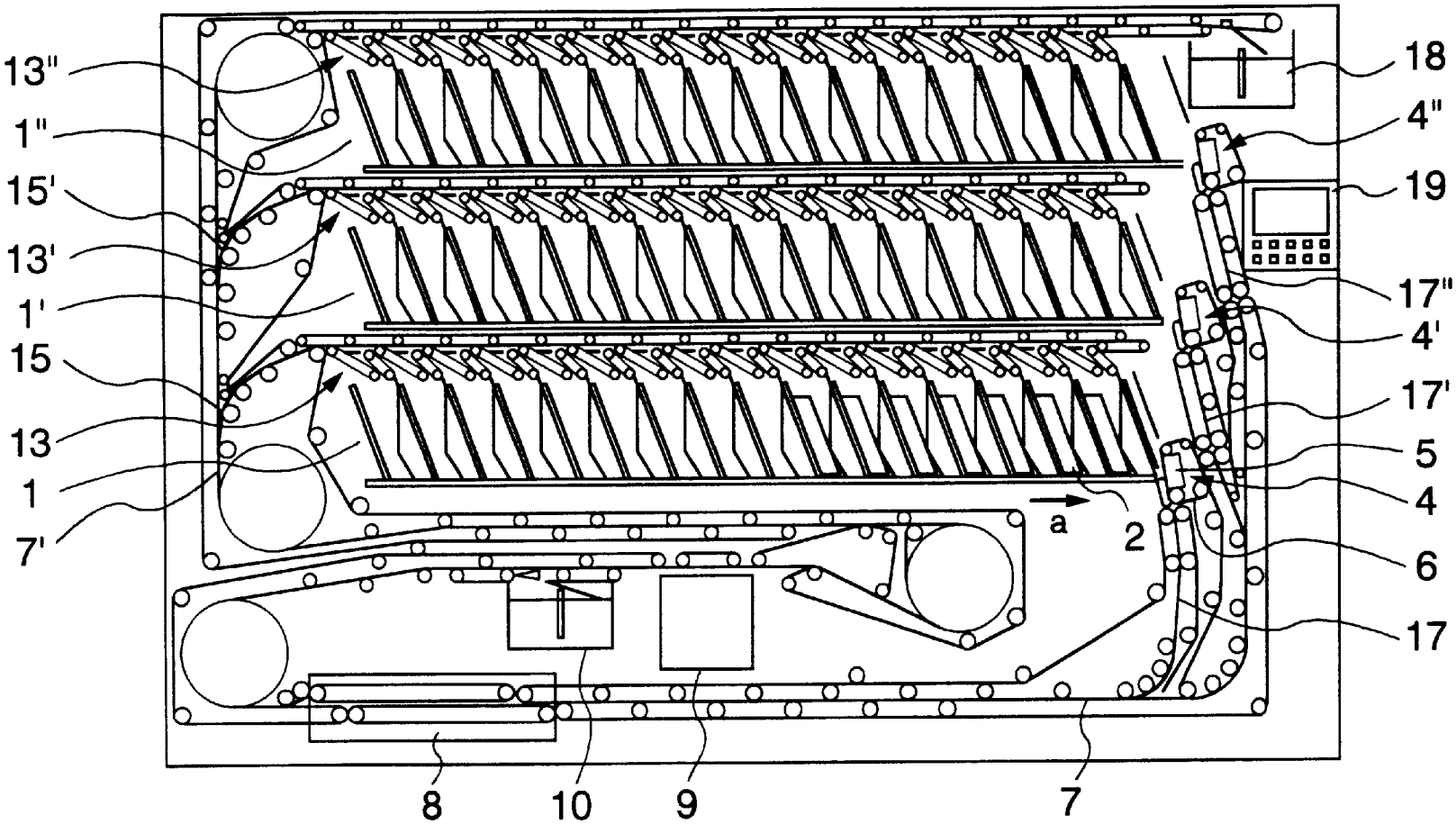
FIG. 1 is a front-elevational view of a sheet-sorting apparatus according to an embodiment of the present invention.

A preferred embodiment of the present invention will now be described with reference to the drawings. FIG. 1 is a view showing a construction of a preferred embodiment of the invention. In FIG. 1, first feeding and stacking means 1 includes a plurality of stackers to enable holding stacks of sheets or the like 2, sorted and stacked in the respective stackers, in a generally upright position, and conveying means for pushing and moving the stacked sheets or the like 2 in a direction of arrow a (here, in the specification, the term "feeding and stacking means" is used since there is no suitable term meaning a structure having functions of a hopper and a stacker. However, the term "stacking shelf" will be often used hereinafter, in which case the stacking shelf serves also as a feeding mechanism unless this is specifically denied. Also, the term "stacking means" will be often used hereinafter, in which case the stacking means also serves as a feeding mechanism unless this is specifically denied.) The first feeding and stacking means 1 can be changed over in its mode such that it is placed in a stacking mode when stacking the conveyed sheets or the like 2 and is in a feeding mode when moving the sheets or the like 2 by the conveying means. Details of this mode changeover operation will be described later. Second and third feeding and stacking means 1' and 1" are similar in construction to the first feeding and stacking means 1, and three feeding and stacking means 1, 1' and 1" are vertically arranged one upon another in contact with one another.

First singulation (a.k.a. singularize) means 4 separates only rightmost one of the stacked sheets or the like 2 placed in the first feeding and stacking means 1 from the remainder to feed the same downward. Generally, such singulation means for sheets or the like comprises a suction system which makes use of a vacuum suction belt, and a vacuum chamber 5 is rendered negative in pressure so that the sheet 2 is attracted by the suction belt 6 which in turn is turned by drive means such as an electric motor, thereby enabling separating and feeding only the rightmost sheet 2. Second and third singulation means 4' and 4" are similar in construction to the first singulation means 4. Conveying means 17 conveys the sheets or the like 2 separated by the first singulation means 4, and conveying means 17' conveys the sheets or the like 2 separated by the second singulation means 4', and conveying means 17" conveys the sheets or the like 2 separated by the third singulation means 4".

Conveying means 7 conveys the sheets or the like 2, and more specifically conveys the sheets or the like 2 conveyed by the conveying means 17, 17' and 17". For example, the conveying means 7 uses belts to interpose the sheet 2 or the like, which are separated by any one of the singulation means 4, 4' and 4", between the belts with the opposite sides of the sheet 2 contacted thereby for conveyance. Posture correction means 8 corrects positions and inclinations of the sheets or the like. Reading means 9 reads a sorting information, such as a bar code applied on the sheets or the like 2. A reject stacking box 10 receives, for example, those sheets or the like 2, which have not been satisfactorily corrected in posture by the posture correction means 8.

First, second and third distributing means 13, 13' and 13" distribute and charge the sheets or the like 2 into any ones of stackers of the feeding and stacking means 1, 1' and 1" in the stacking mode in accordance with the sorting information read by the reading means 9. Gate means 15 and 15' are provided halfway in conveying means 7', which conveys the sheets or the like 2, of which sorting information has been read, to distribute the same to either of the feeding and stacking means 1, 1' and 1" in accordance with the sorting information read by the reading means 9. A reject box 18 receives, in a stacked manner, those sheets or the like 2, of which sorting information has not been read by the reading means 9. The reference numeral 19 denotes an operation panel through which an operator inputs instructions for starting the operation and so on.

Figure 2:
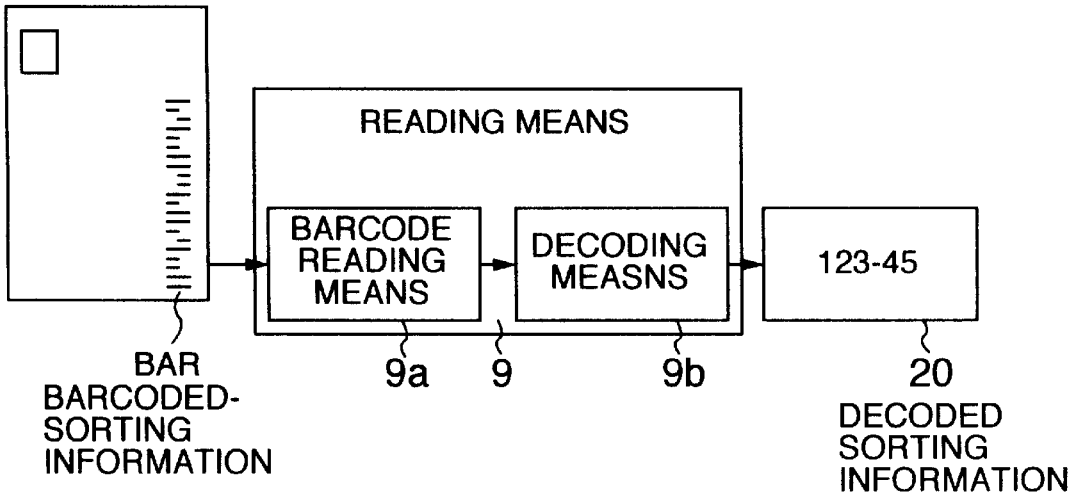
FIG. 2 is a view showing an example of a sorting information and a construction of reading means constituting the sheet-sorting apparatus of the invention.

FIG. 2 is a view showing an example of sorting information applied on the sheets or the like, and a construction of reading means 9, the sorting information and the reading means 9 forming the present invention. In this embodiment, mail is used as the sheets or the like, to which the present invention can be suitably applied. In FIG. 2, bar code reading means 9*a* is provided in the reading means 9 for reading a bar code BAR, for example, representative of a numeral or a character in terms of the length of bars. Decoding means 9*b* decodes the bar code BAR into the original numeral or character, and the reference numeral 20 denotes the sorting information represented by the decoded original numeral or symbol.

Figure 3:
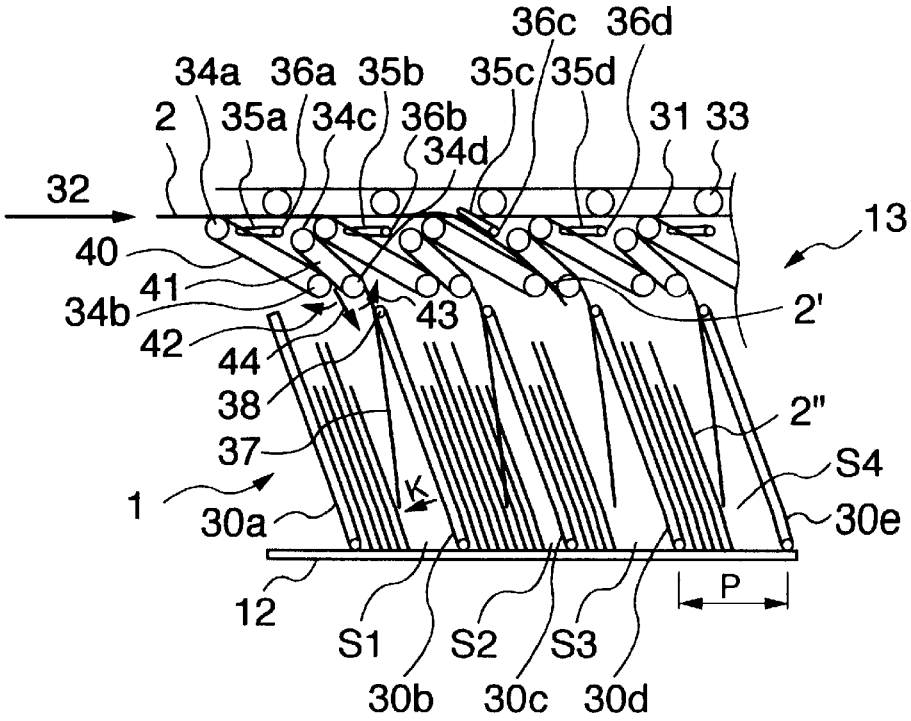
FIG. 3 is a front-elevational view showing one example of a construction of stacking means and distributing means, which constitute the sheet-sorting apparatus of the invention.

FIG. 3 is a front-elevational view showing an example of a construction of the feeding and stacking means 1 and the distributing means 13, which constitute the present invention. In FIG. 3, the interior of the stacking means 1 is partitioned or divided by partitions 30*a*, 30*b*, 30*c* . . . into the stackers S1, S2, S3 . . . . A belt 31 forms a part of the convey path 7, and moves in a direction of arrow 32 to convey the sheets or the like 2. Pulleys 33 drive the belt 31, and also there are provided pulleys 34*a*, 34*b*, 34*c* and 34*d* such that a belt 40 is extended around the associated pulleys 34*a* and 34*b* to run in a direction of arrow 42. A belt 41 is extended around the associated pulleys 34*c* and 34*d* to run in a direction of arrow 43. The pulley 34*a* causes the sheets or the like 2 to be held between the belt 40 and the belt 31 and to be conveyed in the direction of arrow 32 in accordance with the movement of the belt 31. The pulley 34*b* causes the sheets or the like 2 to be held between the belt 40 and the belt 41 and to be conveyed in a direction of arrow 44 upon movement of the belts 40 and 41 to be charged into the stacker S1. A holder or presser 37 is provided in each of the stackers to press the sheets or the like 2, charged into the stacker, against the partition 30*a*, 30*b*, 30*c*, 30*d* in a direction of arrow K with a suitable force or pressure so as to stack the sheets or the like 2 along the partition 30*a*, 30*b*, 30*c*, 30*d*. The respective holder 37 are pivotally movable about axes of rotation 38.

Gate diverters 35*a*, 35*b*, 35*c*, 35*d* . . . are interposed between the belts 40 and the rollers 34 to distribute and charge the sheets or the like 2, conveyed in the direction of arrow 32, into the corresponding stackers S1, S2, S3 . . . The gate diverters 35*a*, 35*b*, 35*c*, 35*d* . . . are pivotally movable through a predetermined angle about their respective axes of rotation 36*a*, 36*b*, 36*c*, 36*d*. The gate diverters 35*a*, 35*b*, 35*c*, 35*d* are disposed respectively on opposite sides of the belt 31, and in the case where the belt 31 comprises a plurality of parallel belts spaced from one another in a widthwise direction of the belt 31, the gate diverters are disposed respectively in gaps between these belts. Thus the belt 31 and the gate diverters 35*a*, 35*b*, 35*c*, 35*d* . . . are so positioned that even when these gate diverters are pivotally moved, they will not contact the belt 31.

Here, for example, when the gate diverters 35*a* and 35*b* are disposed to be generally parallel to the belt 31, the sheets or the like 2 pass through a gap between the gate diverter 35*a* and the belt 31 and a gap between the gate diverter 35*b* and the belt 31 to be conveyed to the gate diverter 35*c*. Here, when the gate diverter 35*c* is angularly moved through a predetermined angle about the axis of rotation 36*c* to position a tip end thereof away from the belt 31 toward the pulley 33, the sheets or the like 2' pass on a side of the gate diverter 35*c* toward the feeding and stacking means 1 to be charged into the stacker S3. Such construction is provided in a manner to provide a required number of stackers in succession at intervals P in a lengthwise of the feeding and stacking means 1, such that the stacking means 1 is divided, for example, into 16 stackers. The sheets or the like 2", sorted and charged into each of the stackers S1 to S16, are arranged along the partitions 30 and are pressed against the partitions 30*a*, 30*b*, 30*c*, 30*d* . . . by the holders 37 to be stacked in a generally upright but somewhat inclined position.

Figure 4:
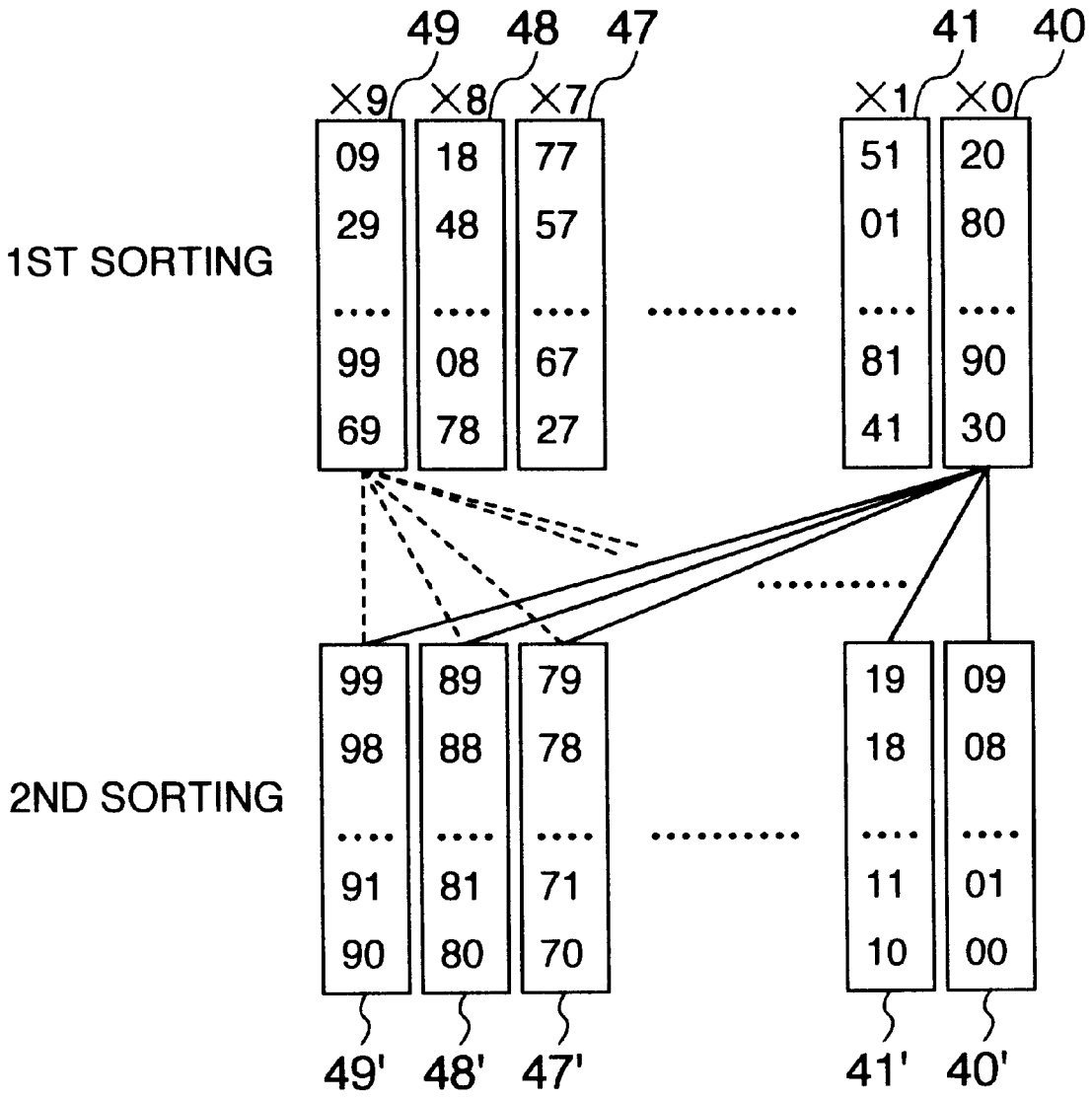

Next, the process of sequencing sheets or the like 2 (that is, sorting operation in accordance with carrier route) will be described. FIG. 4 is an illustration showing an example of sheet sorting operation in accordance with carrier route in the apparatus for sorting sheets or the like (hereinafter referred to as "sheet-sorting apparatus"). For the purpose of explanation, contents of a sorting information are represented by numerals of two figures from 00 to 99, and 100 sheets or the like 2, to which the contents of the sorting information 20 comprising the numerals 00 to 99, are put in random order, are sequenced in order according to the sorting information 20 to thereby effect the sorting operation in accordance with the carrier route. Here, the operations of the constituent elements will not be described in detail, and only the arrangement of the sorting information in the process of sequencing the sheets or the like 2 will be described.

In FIG. 4, stackers 40, 41, . . . 48 and 49 constitute 10 stackers in the first feeding and stacking means 1 to correspond to numerals 0 to 9, respectively. The conveyed sheets or the like 2 are sorted and charged into the corresponding stackers in accordance with their sorting information 20. In a first sorting operation, 0 to 9 in unit's place in the sorting information are assigned respectively to the stackers 40, 41, 42, . . . and 49. Then, the fed sheets or the like 2 are separated and taken out one by one to be distributed and charged into one of the corresponding stackers 40, 41, 42, . . . 49 in accordance with a number in unit's place of their sorting information. Therefore, the sheets or the like 2, having the same number in unit's place in the sorting information, are stacked in the respective stackers 40, 41, 42, . . . and 49. At this time, numbers in ten's place are not the same in the respective stackers.

In a second sorting operation, 0 to 9 in ten's place in the sorting information are assigned respectively to the stackers 40, 41, 42, . . . 49. While the sheets or the like 2, having been subjected to the first sorting operation, are kept unchanged in order, first the sheets or the like 2 stacked in the stacker 40 are sequentially separated and taken out one by one to be distributed and charged into the corresponding stackers 40', 41', 42', . . . 49' in accordance with a number in ten's place in their sorting information. First, only the sheets or the like 2 having 0 in unit's place and taken out from the stacker 40 are distributed and charged into the corresponding stackers 40' to 49' in accordance with a number in ten's place. Then, the sheets or the like 2 having 1 in unit's place and taken out from the stacker 41 are distributed and charged into the corresponding stackers 40' to 49' in accordance with a number in ten's place, and thus are stacked on the sheets or the like 2 having 0 in unit's place. Similarly, the sheets or the like 2 having 2 to 9 in unit's place are sequentially separated and taken out to be distributed and charged into the corresponding stackers 40' to 49' in accordance with a number in ten's place. When all the sheets or the like 2 have been sorted in this manner, the sheets or the like 2 having 00 to 09 in the sorting information, respectively, are stacked in this order in the stacker 40', and the sheets or the like 2 having 90 to 99 in the sorting information, respectively, are stacked in this order in the stacker 49'. Here, when all the sheets or the like 2 stacked in the stackers 40' to 49' are taken out in order, all the sheets or the like 2 are sequenced in order of the numerals 00 to 99 representing the sorting information.

In the above explanation, by way of example, while 100 ways of the sequencing operation from 00 to 99 are effected by twice repeating the sorting of the sheets or the like 2 into 10 stackers, this operation is not limited thereto. If stackers is U in number and repetition is effected n times, then the nth power of U, that is, (Un) ways of the sequencing can be effected. For example, if U is 10 and n is 3, then 1000 ways of the sequencing can be effected.

In the above explanation, the sheets or the like 2 are sequenced with the result that the leftmost one has the sorting information of 99 while the rightmost has the sorting information of 00. However, by reversing the numbers corresponding respectively to the stackers 40 to 49, the sheets or the like 2 can be sequenced such that the right most one has the sorting information of 00 while the leftmost one has the sorting information of 99.

Such a sequencing procedure can be realized by providing means for repeatedly separating and sequencing the sheets or the like, which have been once sorted into the stackers, while keeping the order of the sheets or the like unchanged. For example, a feeding unit and a stacking unit are made adapted for common use, and are adapted for a stacking mode, in which sheets or the like are sorted and stacked in the units, and a feeding mode, in which the thus stacked sheets or the like are fed to the singulation means while kept unchanged in order. Thus, switching is effected between the stacking mode and the feeding mode so that the sheets or the like, once stacked, are again separated and sorted repeatedly.

In order to perform sequencing, it is necessary to repeat the sorting operation several times as described above, and during this operation, the sheets or the like 2 can neither be changed in order, and also sheets or the like 2 can not be added. Therefore, an amount of the sheets or the like 2 to be processed is limited to that which can be stacked in the feeding and stacking means. In this embodiment, an apparatus can be made small-sized while satisfying such conditions as described below.

For the purpose of explanation, the feeding and stacking means in the feeding mode will be referred to as "feeding means", and the feeding and stacking means in the stacking mode will be referred to as "stacking means". Assuming that an average thickness of each sheet 2 is 1 mm and 2,000 sheets or the like 2 are to be processed at a time, the feeding means must have a length of not less than 2 m when all the sheets or the like 2 are fed to the feeding means in close contact with one another. However, when 2,000 sheets or the like 2 are distributed and sorted into the stackers of the stacking means in accordance with addresses, a number of the stacked sheets or the like 2 is different from one stacker to another since a number of the sheets or the like is different depending on the addresses. Besides, in order to stack the sheets or the like 2 without jamming, each stacker must have a certain additional space. For example, in order to stack documents up to a thickness of 80 mm, each stacker must have a space of about 120 mm, that is, an about 1.5 times larger space. As seen from this, in order to uniformly stack the documents amounting to 2 m in thickness, the stacking means must have a space of at least about 3 m of thickness.

Furthermore, as described above, the sheets or the like 2 are not stacked in an equal amount in the stackers, and therefore it may happen that one stacker becomes full while only several sheets or the like 2 are stacked in another stacker. Thus, unless a stacking capacity of the entire stacker means must be larger than 3 m, all the sheets or the like 2 fed to the feeding means can not be stacked in the stacking means. Since those sheets or the like 2, which have failed to be stacked, are rejected and stacked in the reject stacker, they must be processed after a sequence of sorting operations are completed, which decreases an efficiency of the sorting operation. In order to reduce a number of the sheets or the like 2 to be rejected, the stacking capacity of the entire stacking means must be large enough to prevent the stacking means from becoming full of the sheets or the like 2. In view of such allowance, the entire stacking means must have a space amounting to 4 m which is twice larger than the length of the feeding means. If stackers of such stacking means are arranged in series, a width of the sorting machine will amount to as large as about 5 m.

On the other hand, if the stacking means is divided into plural stages, a width of the stacking means can be reduced. With two stages, such width will be about 2 m, and with four stages, it will be about 1 m. However, it is necessary to provide distribution conveying paths which distribute the conveyed sheets or the like 2 to the corresponding stages, and require a width of about 50 cm.

If the stacking means is arranged in two stages, its length will be about 2 m which is substantially the same as that of the feeding means. Therefore, if the two-stage stacking means are provided on the upper portion of the feeding means, both the feeding means and the stacking means can receive about 2,000 sheets or the like 2, and also the sorting machine can be made small-sized to have a small width of about 3 m. Besides, since both the feeding means and the stacking means have a width in the range of about 2 m, an operator suffices to move slightly to have access to the feeding means and the stacking means. Therefore, a burden on a worker is reduced to enable enhancing the environment of labor. Further, if the feeding means and the stacking means, respectively, are a feeding and stacking means which may be in the feeding mode and in the stacking mode, an arrangement shown in FIG. 1, in which three feeding and stacking means are vertically stacked one upon another in contact with one another, is equivalent to an arrangement, in which the two-stage stacking means are stacked on the upper side of the feeding means, so that the apparatus can be made small-sized. The bottom surfaces of the respective feeding and stacking means is about 900 mm high for the lower-most stage, about 1,300 mm high for the intermediate stage, and is about 1,700 mm high for the uppermost stage. Thus, at the startup of the operation, the lowermost stage is put into the feeding mode to feed the sheets or the like, an operator does not need to stoop down and stand on tiptoe, thus making an efficiency of the operation favorable.

Figure 5:
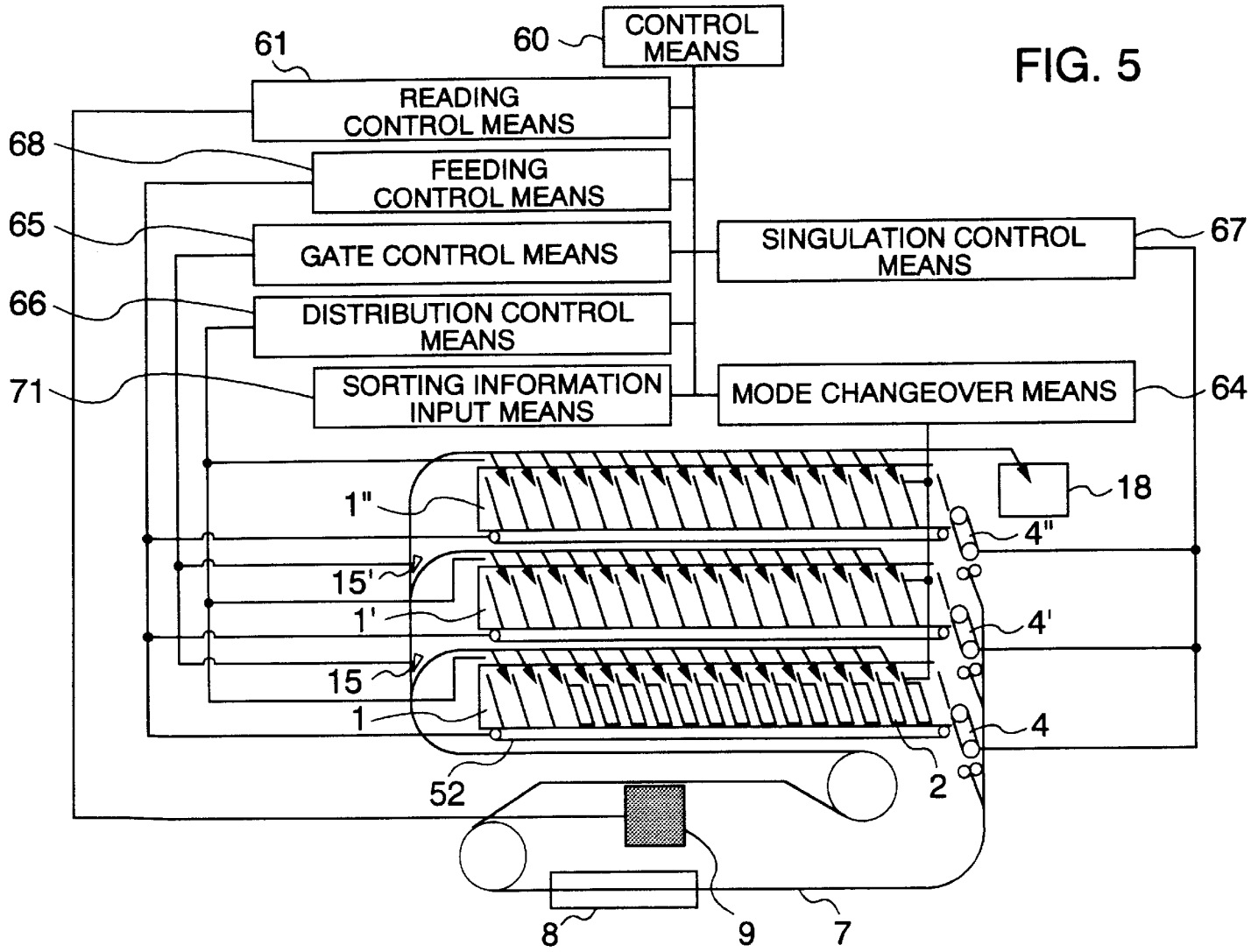
FIG. 5 is a view showing one embodiment of the sheet-sorting apparatus of the invention.

FIG. 5 is a block diagram showing an embodiment of the sheet-sorting apparatus of the invention. In FIG. 5, reading control means 61 controls the reading means 9. Mode changeover control means 64 controls the feeding and stacking means 1, 1', 1" to switch the same between a feeding mode, in which the documents are fed to the singulation means 4, and a stacking mode, in which the conveyed documents are sorted and stacked. Gate control means 65 controls the gate means 15 and 15', distribution control means 66 controls the distributing means 13, 13' and 13", and feeding control means 68 controls the feeding and stacking means 1, 1', 1" in the feeding mode. Singulation control means 67 controls the singulation means 4, 4' and 4".

Sorting information input means 71 can input a sorting information of the sheets or the like 2. Control means 60 controls the reading control means 61, the mode changeover control means 64, the gate control means 65, the distribution control means 66, the singulation control means 67, the feeding control means 68 and the sorting information input means 71.

First, description will be made of a sorting operation, in which the fed sheets or the like 2 are sorted per each mail carrier in charge of mail delivery. The first feeding and stacking means 1 is put into the feeding mode, and the second and third feeding and stacking means 1' and 1" are put into the stacking mode. The stackers of the second feeding and stacking means 1' and the third feeding and stacking means 1" are assigned to the respective carriers, and the sheets or the like 2 are separated by the singulation means 4. If each of the second and third feeding and stacking means 1' and 1" includes 16 stackers, thus the both feeding and stacking means include 32 in total, and the carriers are not more than 32, then the stackers can be individually assigned to the carriers, respectively. A carrier in charge of each individual sheet 2 can be identified from the sorting information read by the reading means 9, and therefore the sheets or the like 2 are charged into the stackers corresponding respectively to the carriers. If the sheets or the like 2 to be stacked in the respective stackers are shifted onto trays or the like, the sorted sheets or the like 2 sorted for the respective carriers are stacked on the associated trays, so that the sheets or the like 2 can be sorted to the carriers.

Next, a carrier route sorting operation for sequencing the sheets or the like 2 (1,000 to 2,000 sheets), having been sorted to the carriers, into a carrier route in accordance with about 1,000 addresses will be described with reference to FIGS. 6 to 11.

Figure 6A:
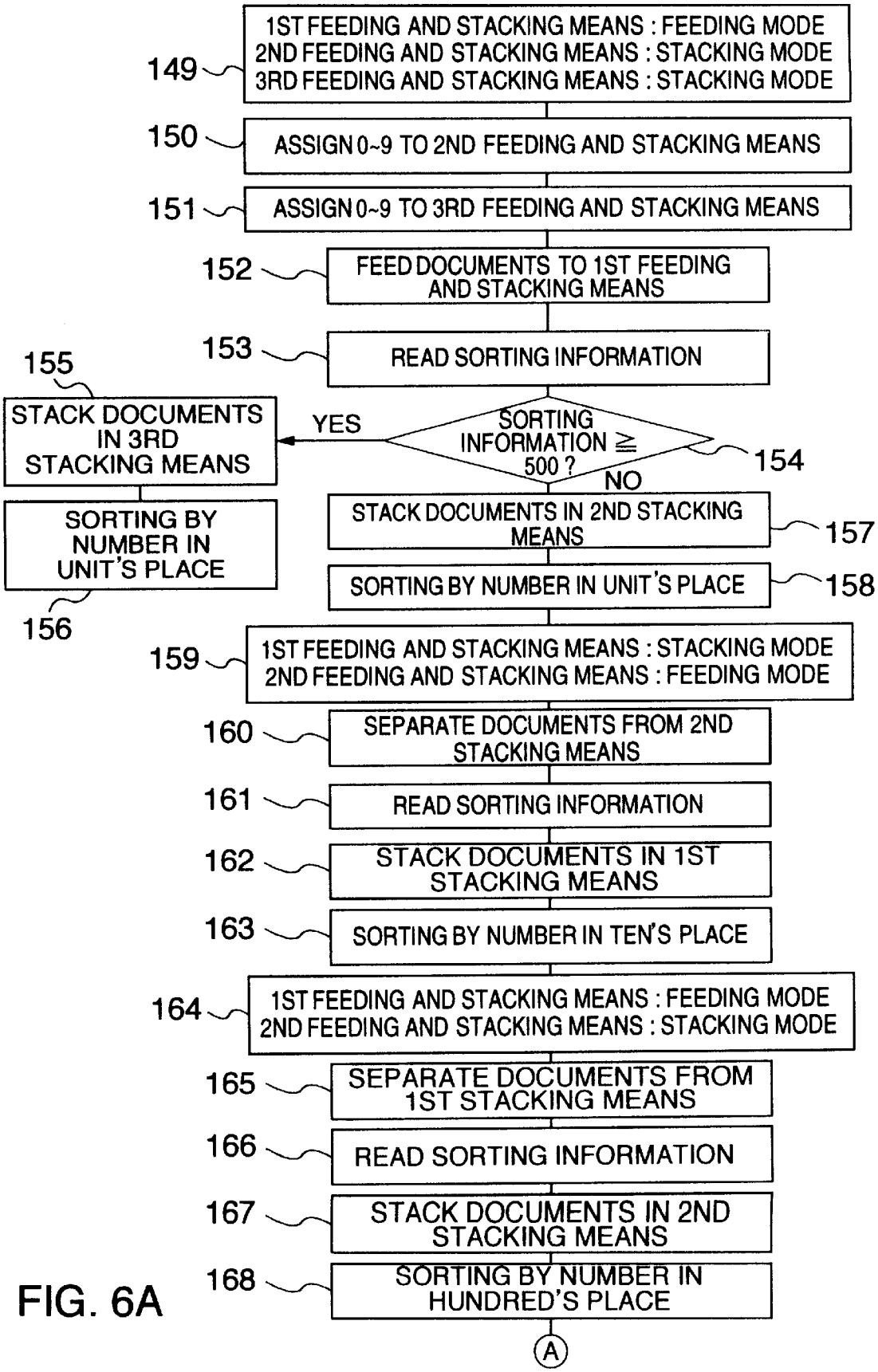
FIGS. 6A and 6B show a flow chart of one example of a sorting operation in accordance with carrier route in the sheet-sorting apparatus of the invention.
Figure 6B:
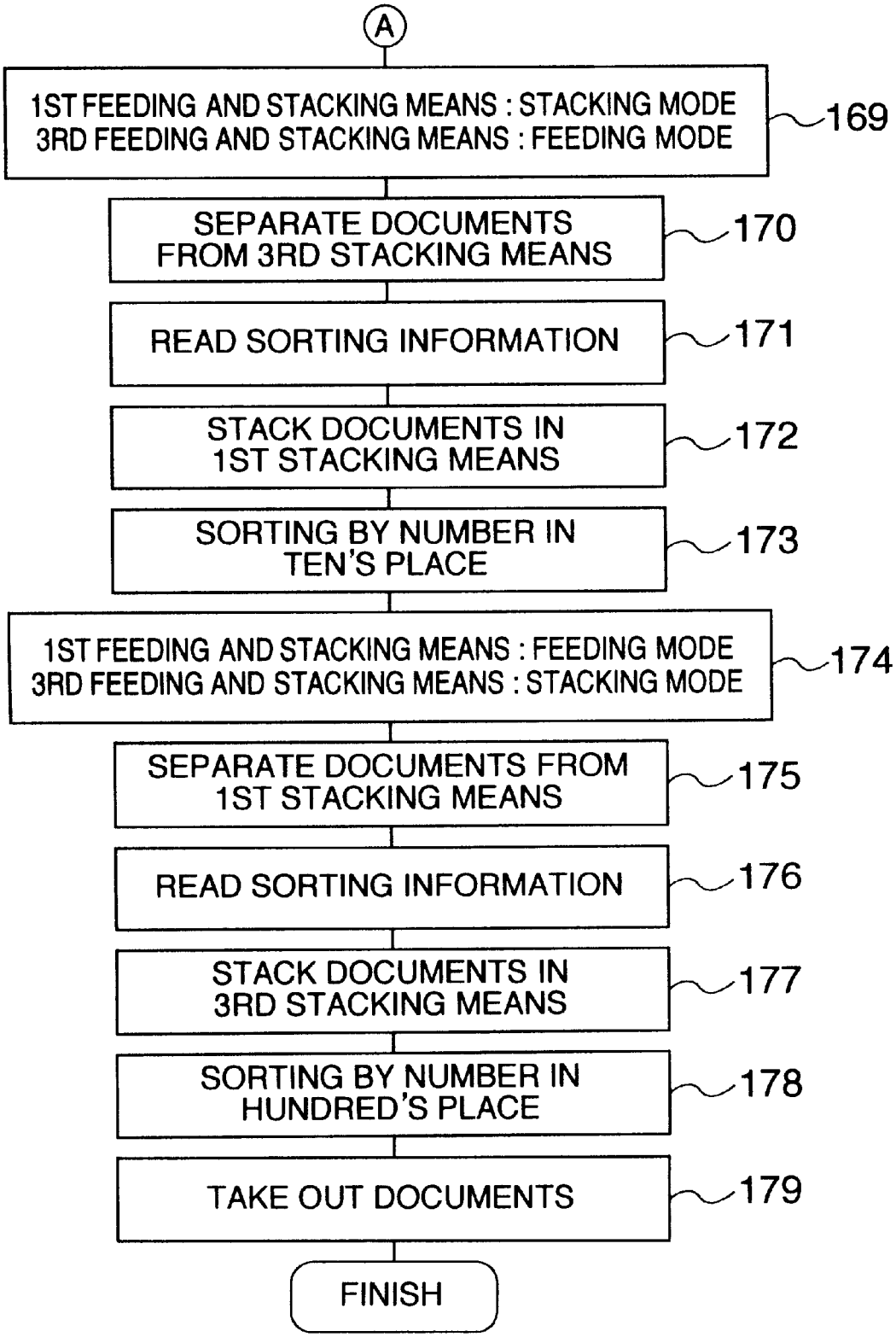
Figure 7:
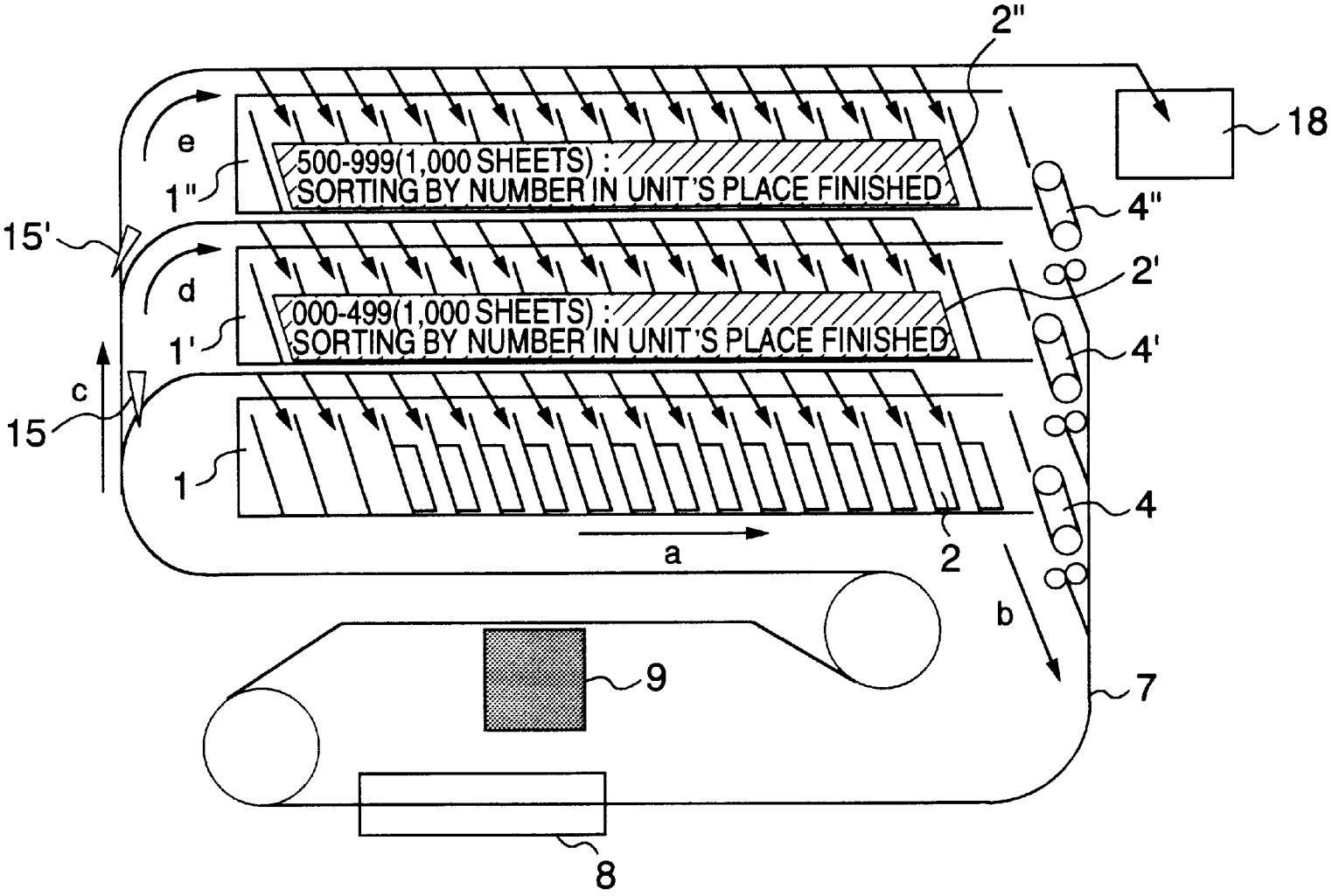
FIG. 7 is a view showing one example of a sorting operation in the sheet-sorting apparatus of the invention.

FIG. 6 is a flow chart showing an example of a sorting operation in accordance with the carrier route, and FIGS. 7 to 11 are views showing a process of the sorting operation in accordance with the carrier route. First, the first feeding and stacking means 1 is placed in the feeding mode, and the second and third feeding and stacking means 1' and 1" are placed in the stacking mode (Step 149). Then, a carrier route information, representing a correlation between the carrier route of the carriers and a sorting information 20, is inputted from the sorting information input means 71, and numbers 0 to 9, respectively, are assigned to the respective stackers of the second feeding and stacking means 1' (Step 150). Also, numbers 0 to 9, respectively, are assigned to the respective stackers of the third feeding and stacking means 1" (Step 151). After this setting is completed, the sheets or the like 2 to be subjected to the sorting operation in accordance with the carrier route are manually charged into the first feeding and stacking means 1 placed in the feeding mode (Step 152), and are separated one by one by the singulation means 4 to permit the sorting information to be read by the reading means 9 (Step 153). Here, in the first feeding and stacking means 1, the sheets or the like 2 are conveyed in a direction of arrow a toward the singulation means 4, as shown in FIG. 7, and are separated one by one by the first singulation means to be conveyed in a direction of arrow b.

Then, it is judged whether or not the sorting information is not less than 500 (Step 154). If the sorting information is in the range of between 500 and 999, the sheets or the like is conveyed to the third feeding and stacking means 1" to be sorted and stacked in the corresponding stacker in accordance with numbers in unit's place in the sorting information (Step 155 to Step 156). The sheets or the like 2, of which sorting information 20 is in the range of between 000 and 499 are conveyed to the second feeding and stacking means 1', and these sheets or the like are sorted and stacked in the corresponding stackers in accordance with the number of units of the sorting information (Step 157). Namely, in FIG. 7, the gate means 15 is not operated, and the sheets or the like 2 are conveyed in a direction of arrow c. The gate means 15' is operated depending on whether or not the sorting information 20 is not less than 500, and guides the sheets or the like in a direction of arrow d or a direction of arrow e.

When the operation up to this Step 157 is completed and all the fed sheets or the like 2 are stacked in the second feeding and stacking means 1' and the third feeding and stacking means 1", the sheets or the like 2' having the sorting informations 20 composed of numbers 000 to 499 are stacked in the second feeding and stacking means 1' while the sheets or the like 2", respectively having the sorting informations 20 composed of numbers 500 to 999 are stacked in the third feeding and stacking means 1", as shown in FIG. 7. In either of the two stacking means, the sheets or the like 2 having the same number in unit's place in the sorting information 20 are stacked in the respective stackers. In this embodiment, the description is made with respect to decimal digits, but hexadecimal digits can be used. The reason why not less than 10 stackers are provided is that if a number of sheets or the like stacked in a certain stacker is great, the same sorting information is assigned to two or more stackers. All the sorting informations are read in the first sorting operation whereby from the second sorting operation on, an amount of the sheets or the like to be received in each stacker can be known, so that if the sheets or the like exceeding the capacity of some stacker are to be received in a certain stacker, two or more stackers can be assigned to the same sorting information.

Figure 8:
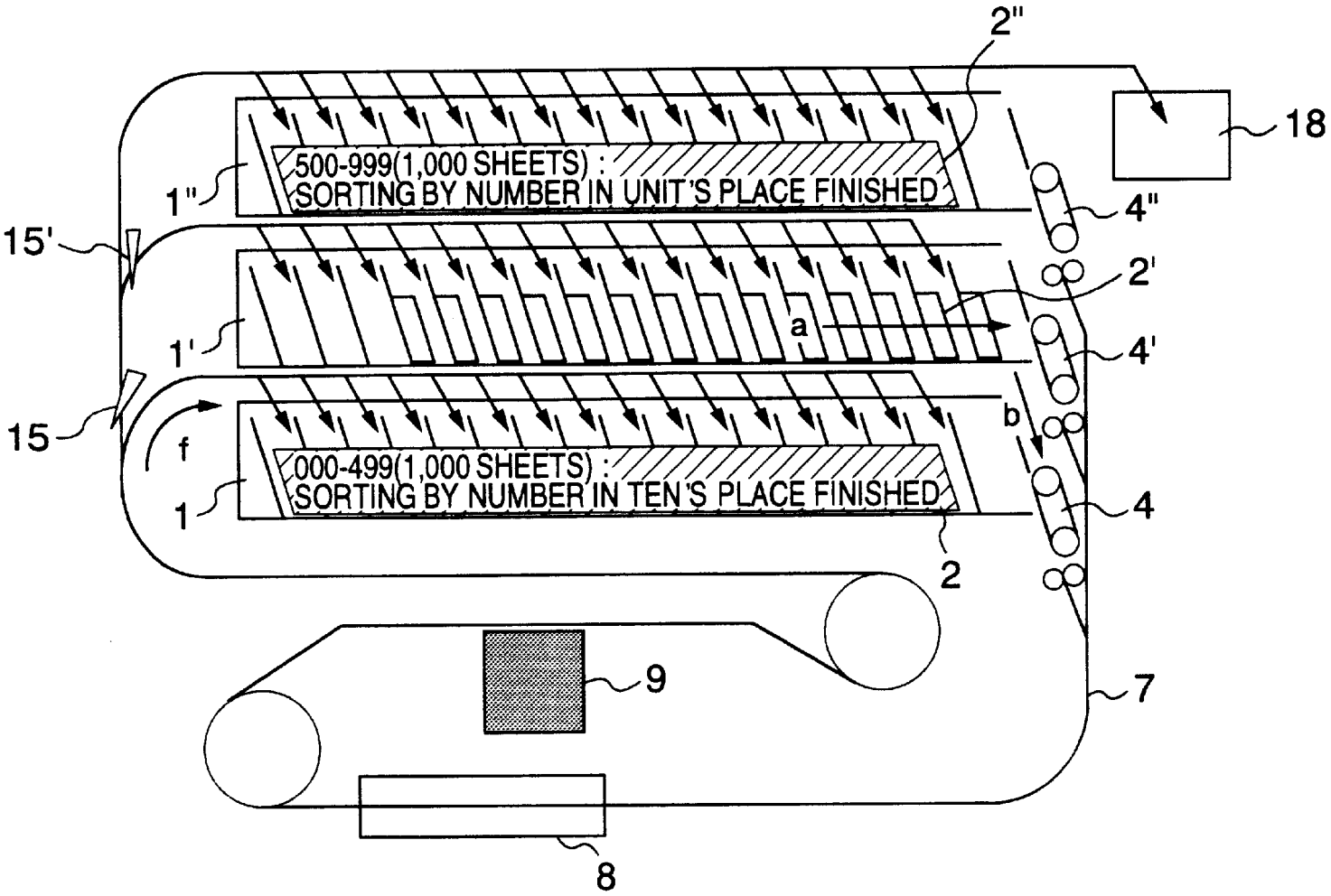
FIG. 8 is a view showing another example of a sorting operation in accordance with carrier route in the sheet-sorting apparatus of the invention.

After all the sheets or the like have been sorted and stacked in the corresponding stackers, the mode changeover control means 64 switches the first feeding and stacking means 1 from the feeding mode to the stacking mode, and also the second feeding and stacking means 1' from the stacking mode to the feeding mode (Step 159), and the sheets or the like 2' in the second feeding and stacking means 1' are again separated one by one (Step 160) to permit the sorting information thereof to be read by the reading means 9 (Step 161). Then, the sheets or the like are sorted in accordance with numbers in ten's place in the sorting information, and are stacked in the corresponding stackers in the first feeding and stacking means 1 (Steps 162 to 163). A state, in which the sorting so far is completed, is shown in FIG. 8.

Figure 9:
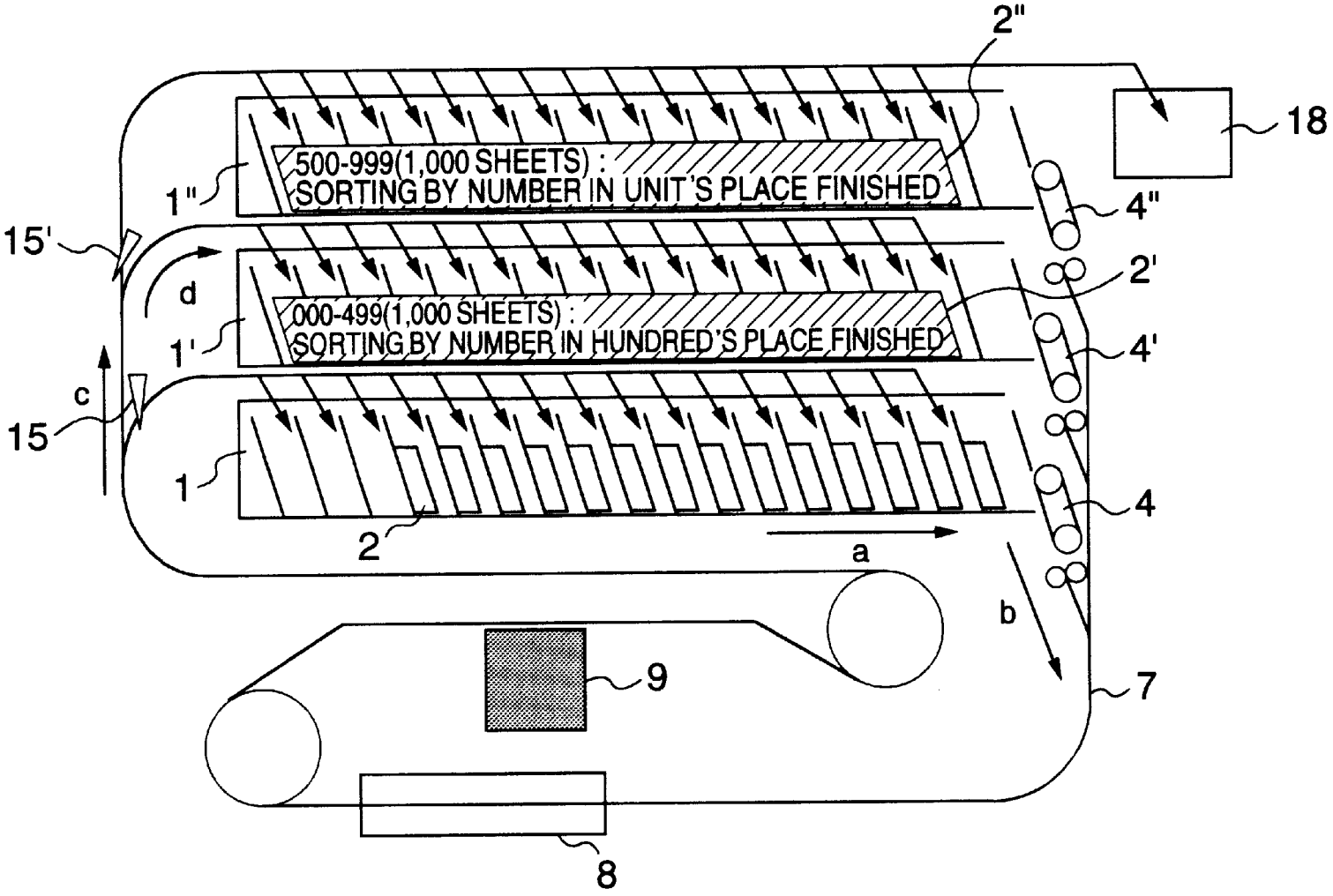
FIG. 9 is a view showing a further example of a sorting operation in accordance with carrier route in the sheet-sorting apparatus of the invention.

After all the sheets or the like have been sorted and stacked in the corresponding stackers, the mode changeover control means 64 switches the first feeding and stacking means 1 from the stacking mode to the feeding mode, and also the second feeding and stacking means 1' from the feeding mode to the stacking mode (Step 164), and the sheets or the like 2 in the first feeding and stacking means 1 are again separated one by one (Step 165) to permit the sorting information thereof to be read by the reading means 9 (Step 166). Then, the sheets or the like are sorted in accordance with numbers in hundred's place in the sorting information to be stacked in the corresponding stackers in the second feeding and stacking means 1' (Steps 167 to 168). When the operation up to Step 168 is completed, the carrier route sequencing operation for the sheets or the like 2 having the sorting informations 20 composed of numbers 000 to 499 is completed. This state is shown in FIG. 9.

Then, the mode changeover control means 64 switches the first feeding and stacking means 1 from the feeding mode to the stacking mode, and also the third feeding and stacking means 1" from the stacking mode to the feeding mode (Step 169). The sheets or the like 2" having the sorting informations 20 composed of numbers 500 to 999 and stacked in the third feeding and stacking means 1" are again separated one by one (Step 170) to permit the sorting information thereof to be read by the reading means 9 (Step 171).

Figure 10:
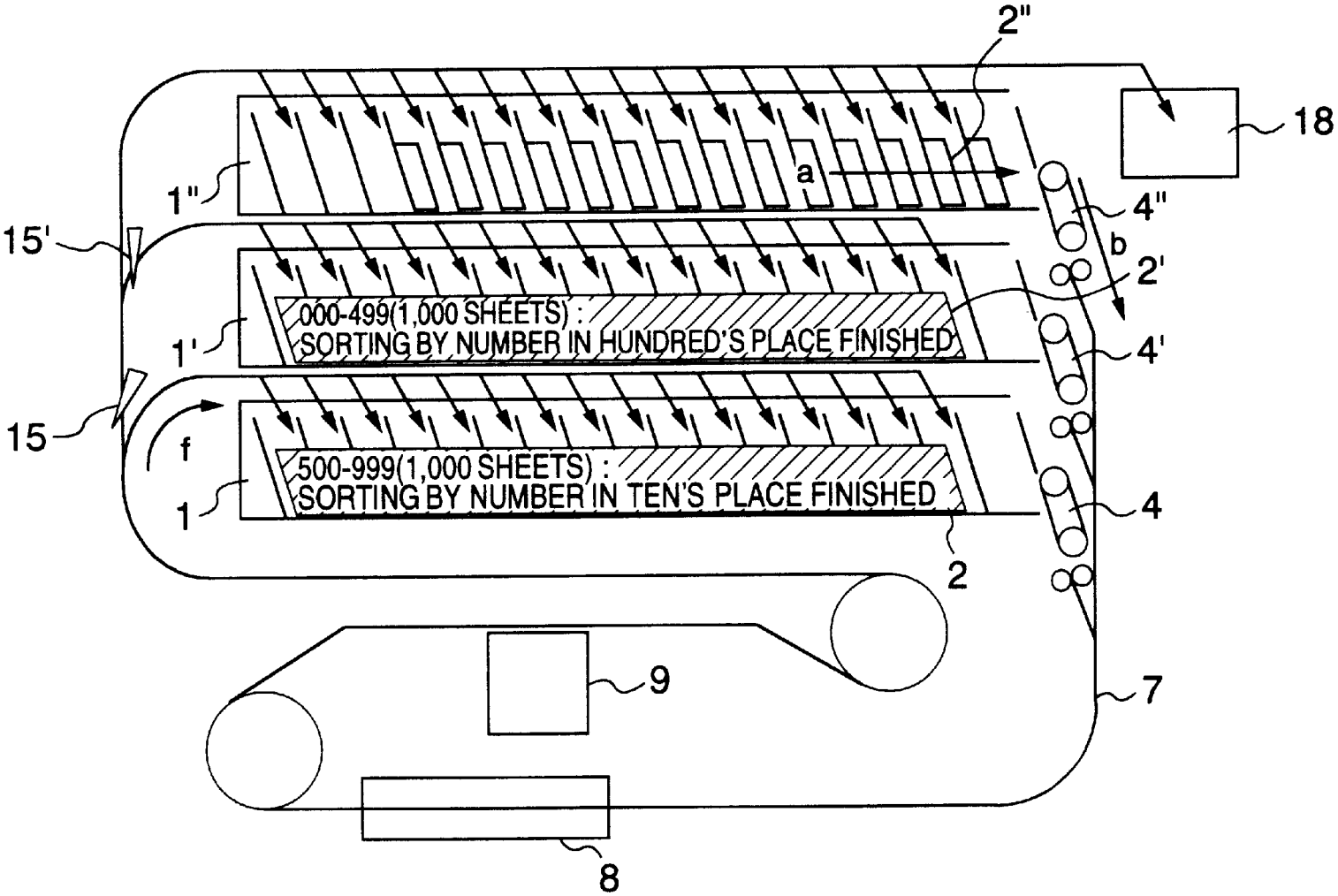
FIG. 10 is a view showing another example of a sorting operation in accordance with carrier route in the sheet-sorting apparatus of the invention.

These sheets or the like 2 having already been subjected to the sorting in accordance with numbers in unit's place by Step 156 are sorted in accordance with numbers in ten's place, and are sorted and stacked in the corresponding stackers in the first feeding and stacking means 1 (Step 172 to Step 173). A state, in which the sorting so far is completed, is shown in FIG. 10.

After all the sheets or the like are sorted and stacked in the corresponding stackers, the first feeding and stacking means 1 is switched from the stacking mode to the feeding mode, and also the third feeding and stacking means 1" is switched from the feeding mode to the stacking mode (Step 174). The sheets or the like 2" in the first feeding and stacking means 1 are again separated one by one (Step 175) to permit the sorting information thereof to be read by the reading means 9 (Step 176). Then, the sheets or the like are now sorted in accordance with numbers in hundred's place in the sorting information to be stacked in the corresponding stackers in the third feeding and stacking means 1" (Steps 177 to 178).

Figure 11:
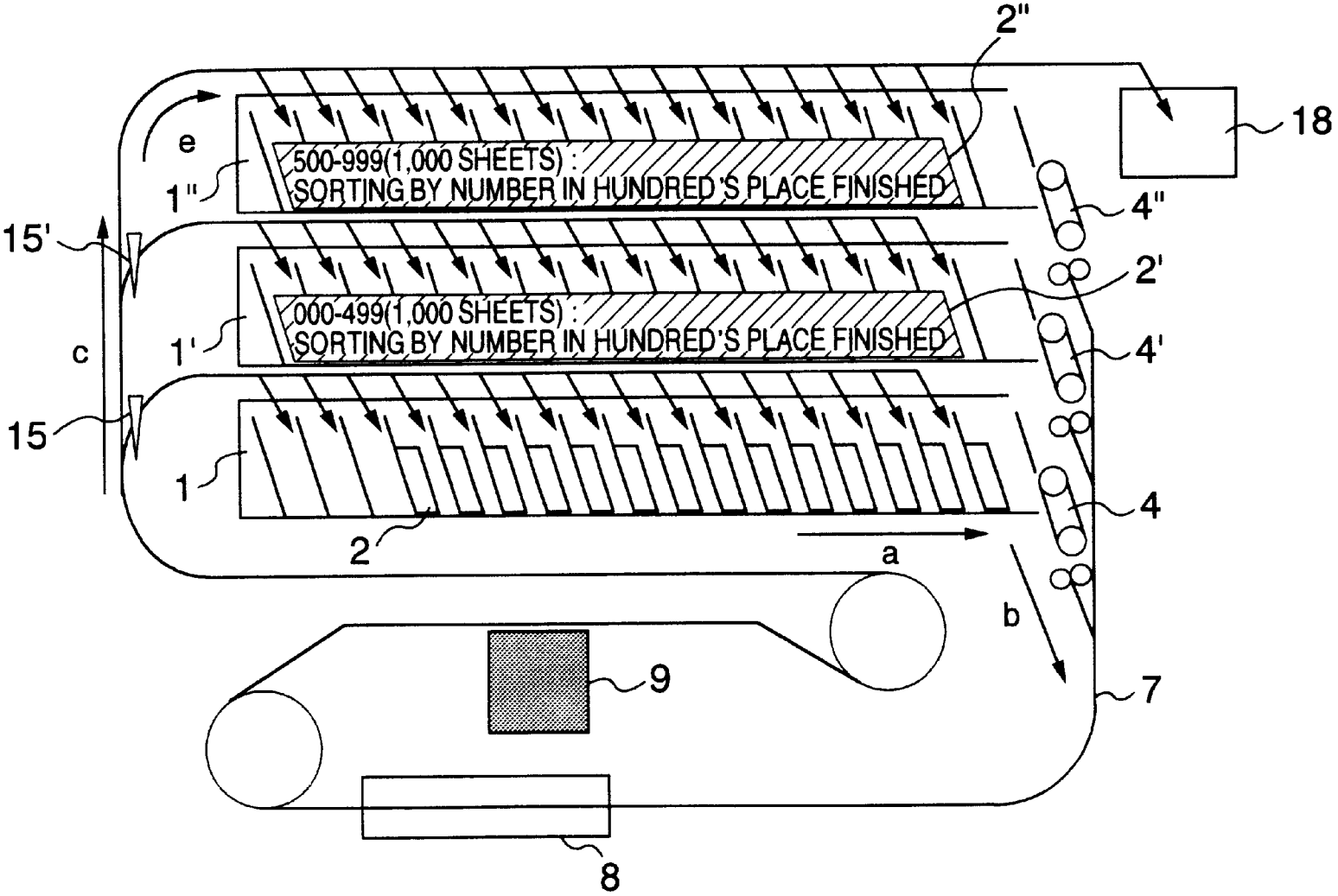
FIG. 11 is a view showing a still further example of a sorting operation in accordance with carrier route in the sheet-sorting apparatus of the invention.

FIG. 11 shows a state, in which the operation up to Step 178 is completed and the sheets or the like 2 having the sorting informations composed of numbers 500 to 900 have been subjected to sequencing. Here, first, the sheets or the like 2 having the sorting informations 20 composed of numbers 000 to 499 are taken out of the second feeding and stacking means 1', and the sheets or the like 2 having the sorting informations 20 composed of numbers 500 to 999 are taken out of the third feeding and stacking means 1". Being arranged in this order, all the sheets or the like 2 having the sorting informations 20 composed of numbers 000 to 999 are sequenced in accordance with the carrier route (Step 179).

In Step 154, it is judged whether or not the sorting information 20 is not less than 500. However, for example, when it is already known that an amount of the sheets or the like having the sorting information 20 composed of numbers 500 or less is relatively large, it is preferred to judge whether or not the sorting information is composed of numbers 400 or more since a difference between an amount of the sheets or the like 2 to be stacked in the second feeding and stacking means 1' and an amount of the sheets or the like 2 to be stacked in the third feeding and stacking means 1" is small.

The above-mentioned operation enables sequencing the fed sheets or the like. In order to achieve this sequencing operation, the sheets or the like stacked in the respective stackers in the feeding and stacking means 1 should be conveyed to the singulation mechanism 4. However, as described above with reference to FIG. 3, each stacker has the partition 30 (for the purpose of explanation, if it is not particularly necessary to distinguish the partitions 30*a*, 30*b*, 30*c*, 30*d* from one another, the partition will be designated merely by the reference numeral 30 with the suffixes a to d omitted) and the holder 37, and therefore in order to convey the sheets or the like 2, which are stacked, for example, in the stacker S1 shown in FIG. 3, rightward to the singulation mechanism 4, the partition 30 and the holder 37 should be moved together with the sheets or the like 2 or should retract from the interior of the feeding and stacking means 1 and the sheets or the like 2 should be conveyed to the singulation mechanism by some means.

Therefore, with reference to FIGS. 12 to 26, explanation will be made of a construction and an operation of mode changeover means for feeding the sheets or the like 2, stacked in the feeding and stacking means 1 place in the stacking mode, to the singulation means 4 after the feeding and stacking means 1 is switched to the feeding mode.

In this construction, the following three kinds of operations and operations, in which the partition and the holder reversely act to return their respective original positions, can be effected (see FIG. 3). More specifically, (1) the holder 37 is drawn to a position near to the partition 30, and (2) the holder 37 and the partition 30 are shortened or contracted, and (3) the holder 37 and the partition 30 are retracted inwardly while kept in the shortened condition. First, the constructions of the partition 30 and the holder 37 will be described, and then the constructions corresponding to the respective operations will be described.

Figure 12:
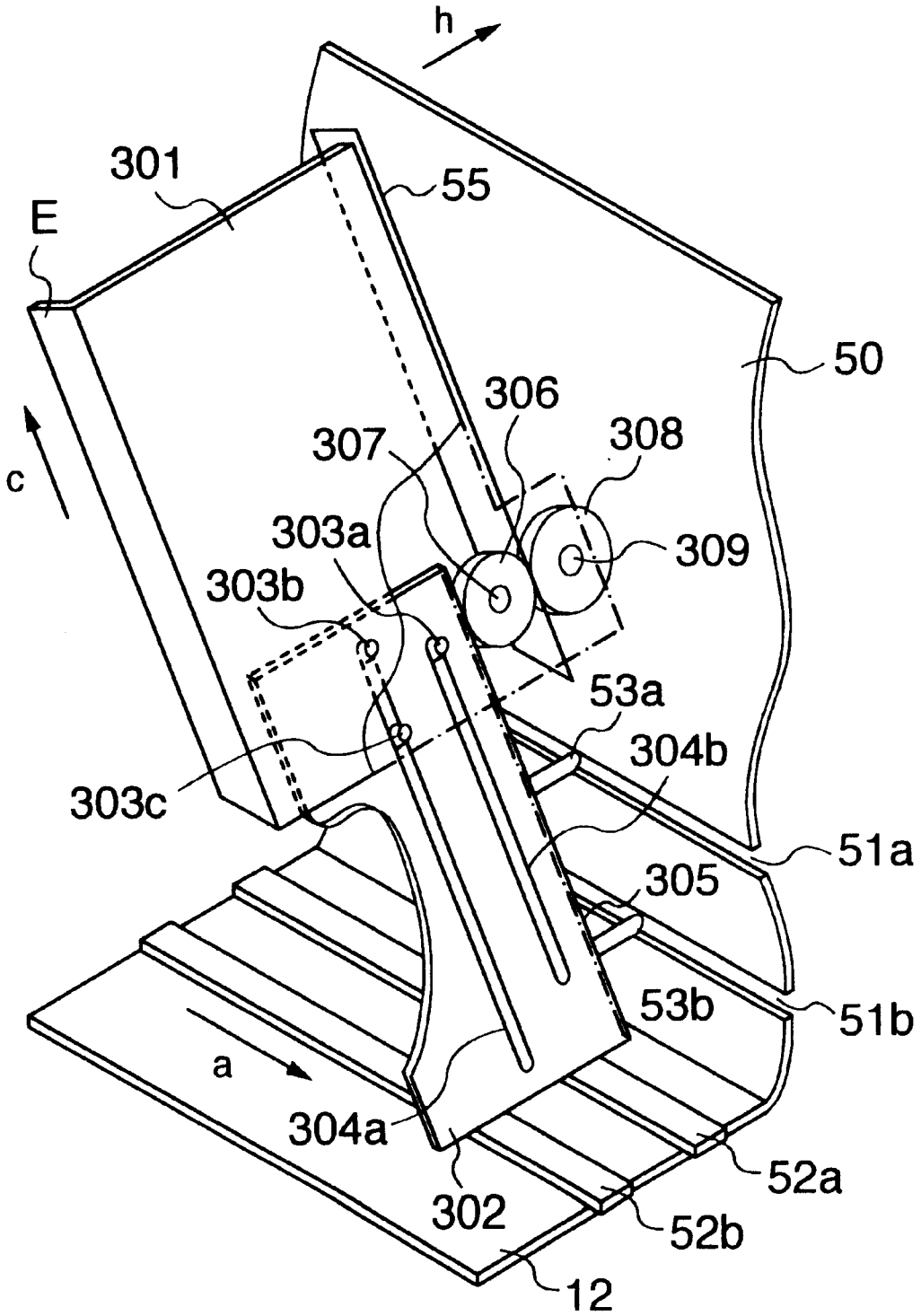
FIG. 12 is a perspective view showing a construction of an example of a partition in the sheet-sorting apparatus of the invention.
Figure 13:
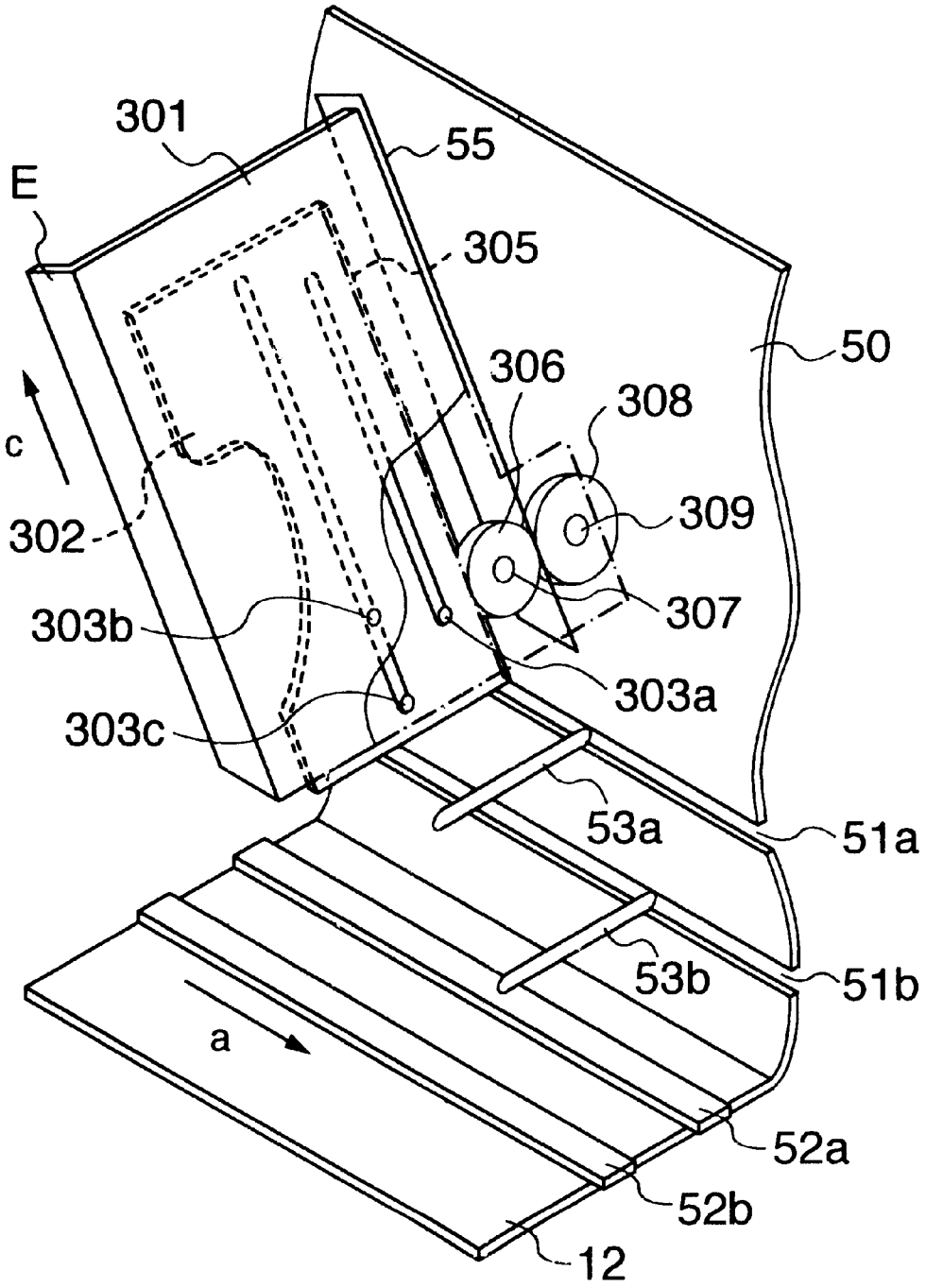
FIG. 13 is a perspective view showing a construction of the partition in the sheet-sorting apparatus of the invention.
Figure 14:
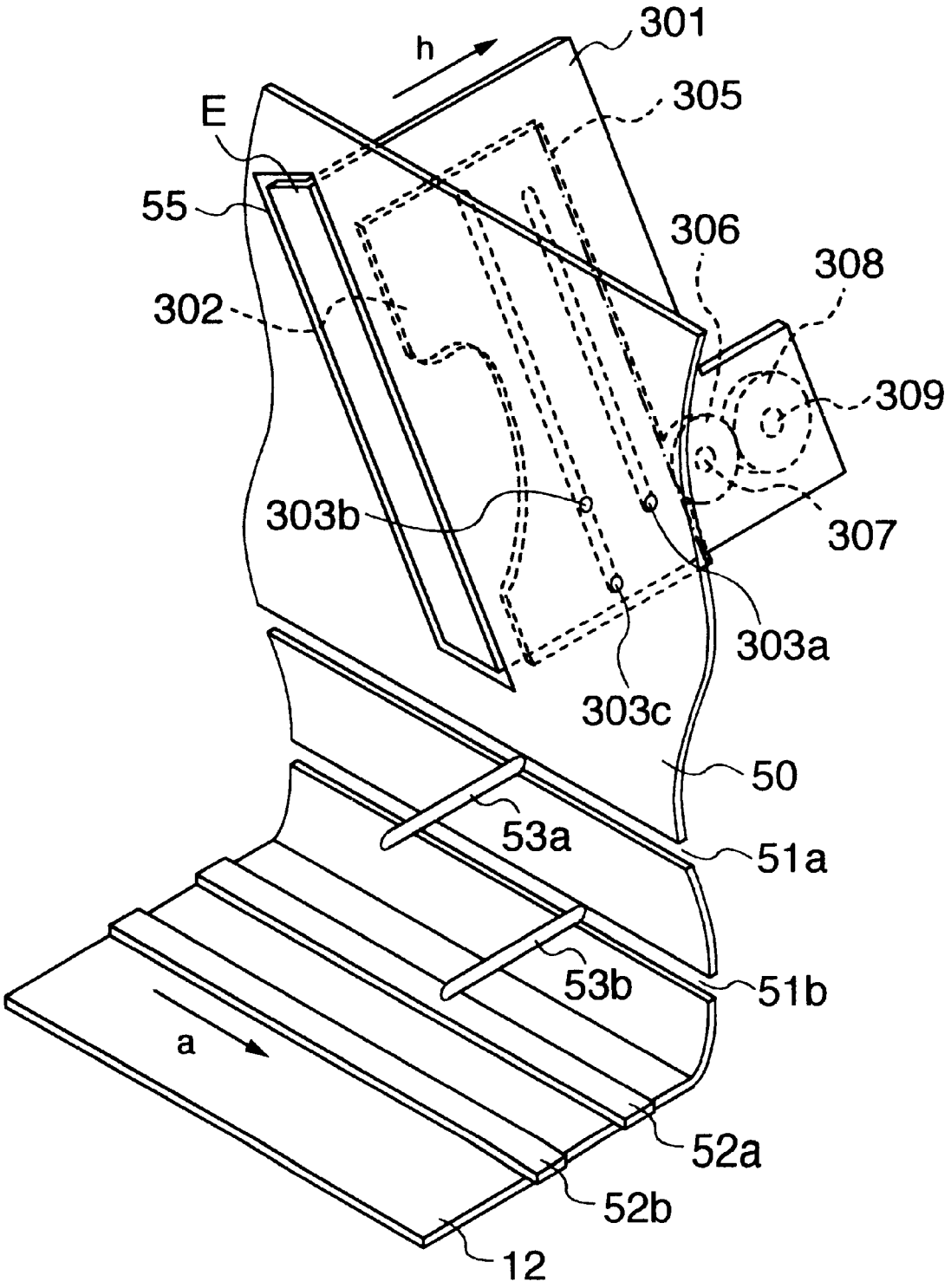
FIG. 14 is a perspective view showing the construction of the partition in the sheet-sorting apparatus of the invention.

FIGS. 12 to 14 are perspective views showing a construction of the partition 30. In FIGS. 12 to 14, the reference numerals 301 to 309 designate components which constitute the partition 30 and comprise a partition plate 301, an auxiliary partition plate 302 having slots 304*a*, 304*b* and pins 303*a*, 303*b* and 303*c* fixedly secured to the partition plate 301 and fitted in the slot 304*a*, 304*b*, the auxiliary partition plate 302 being movable along the partition plate 301 in a direction of arrow c. For the purpose of explanation, the partition plate 301 is partly broken.

A rack 305 is formed on one side edge of the auxiliary partition plate 302, and a gear 306 (gear A) is in mesh with the rack 305 and is rotatable about a shaft 307 fixedly mounted on the partition plate 301. A gear 308 (gear B) is in mesh with the gear A and is rotatable about a shaft 309 fixedly mounted on the partition plate 301. A portion E is formed by bending one side edge portion of the partition plate 301.

An inner plate 50 defines an inner surface of the feeding and stacking means 1, and the sheets or the like 2 are stacked in the feeding and stacking means 1 with side surfaces thereof along the inner plate 50. Bottom belts 52*a* and 52*b* are movable along a bottom plate 12 in the direction of arrow a. A hole 55 is formed through the inner plate 50, and is a size larger than the partition plate 301. The hole 55 allows the partition wall 301 to move in a direction of arrow h. Grooves 51 are formed through the inner plate 50, and forks 53*a*, 53*b* are received in the grooves 51 for movement therealong to be movable in synchronism with the bottom belts 52*a*, 52*b* in the direction of arrow a so as to feed and convey the stacked sheets or the like 2 to the singulation means 4. FIG. 13 shows a state, in which the auxiliary partition plate 302 is moved along the partition plate 301 into a retracted position in the direction of arrow c.

FIG. 14 shows a state, in which the partition plate 301 and the retracted auxiliary partition plate 302 are moved in a direction of arrow h to be retracted to a position behind the inner plate 50. At this time, a bent portion E of the partition plate 301 lies flush with the inner plate 50. Details of a construction of a mechanism for effecting the above operations will be described later.

Figure 15:
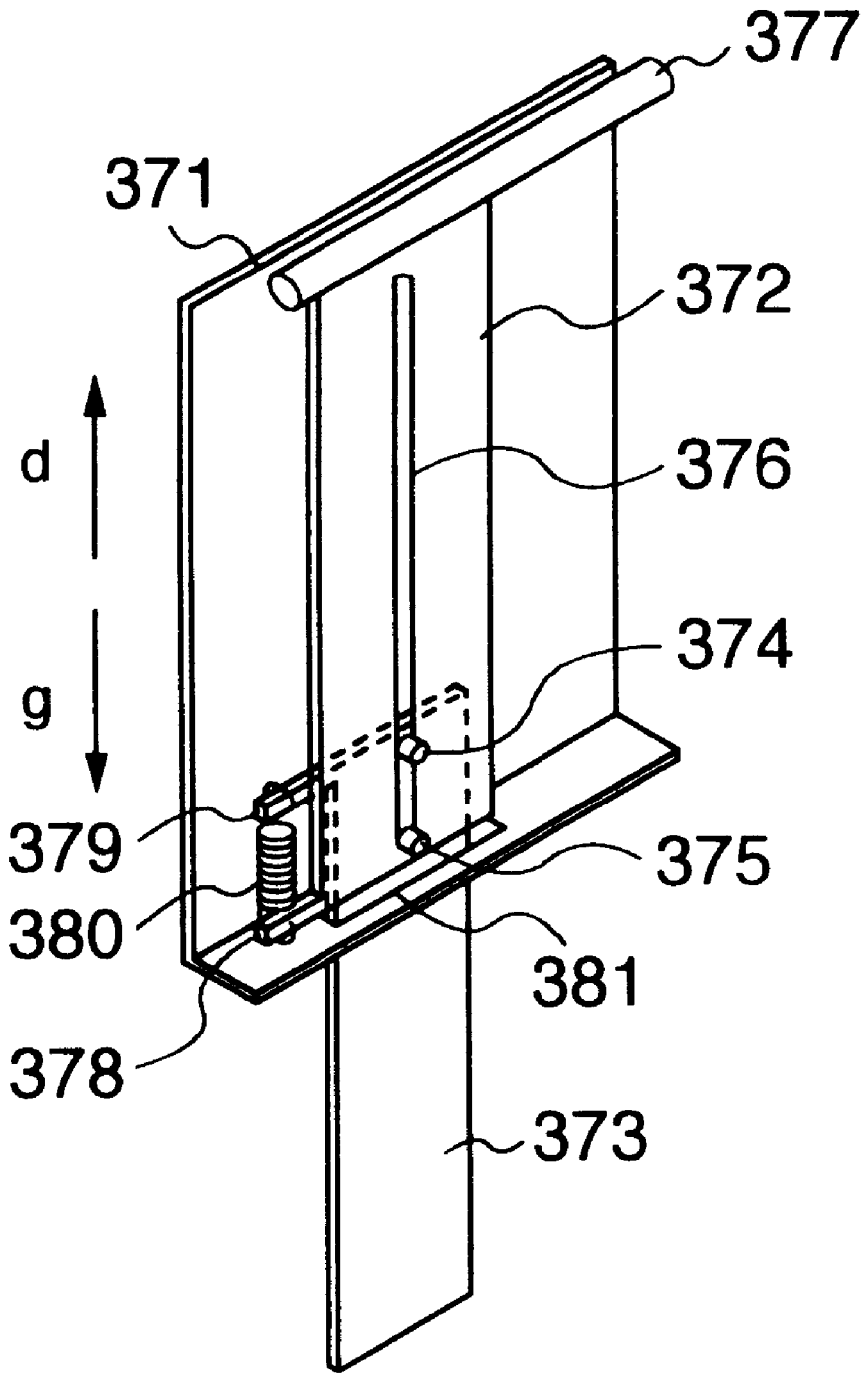
FIG. 15 is a perspective view showing one example of the construction of a holder in the sheet-sorting apparatus of the invention.
Figure 16:
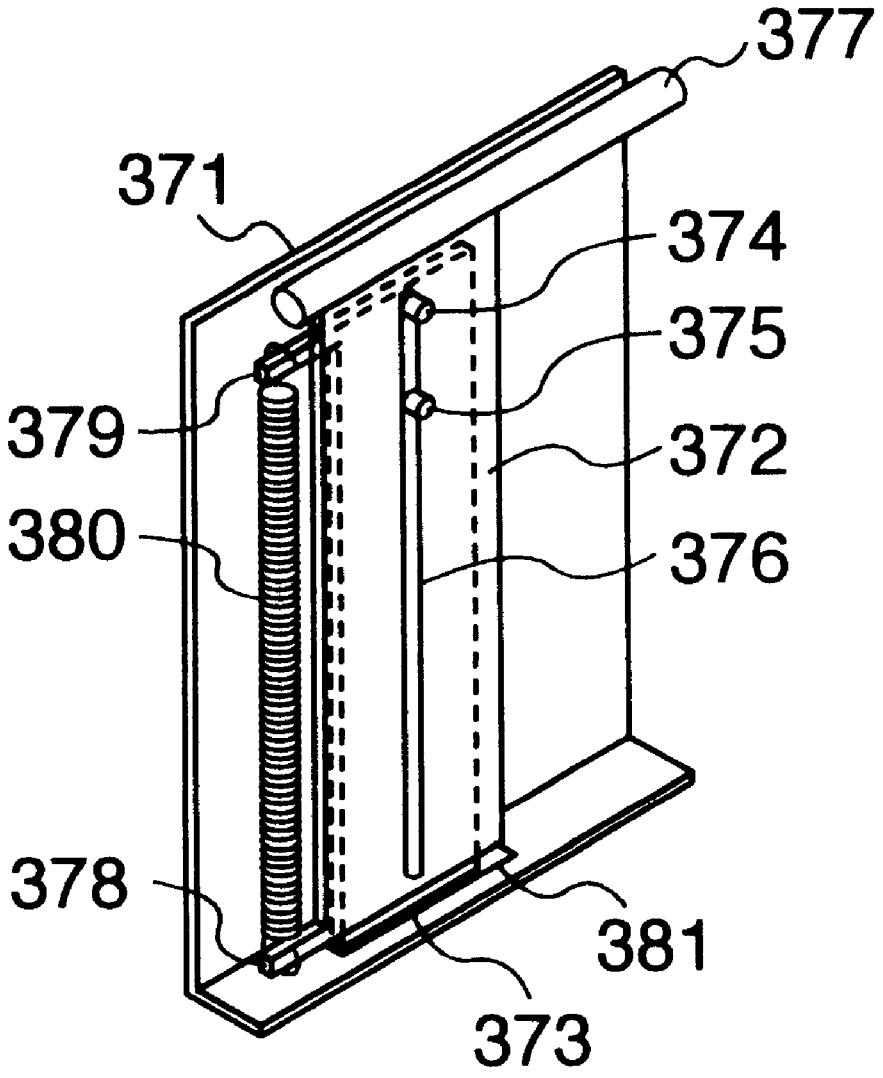
FIG. 16 is a perspective view showing the construction of the holder in the sheet-sorting apparatus of the invention.

FIGS. 15 and 16 are perspective view showing a construction of the holder 37. In FIGS. 15 and 16, the reference numerals 371 to 381 designate elements which constitute the holder 37 and comprise a holder cover 371, a holder base 372, and a holder plate 373, pins 374 and 375 fixedly secured to the holder plate 373 and fitted in a slot 376 formed through the holder base 372, the holder plate 373 being movable along the holder base 372 in directions of arrow d and arrow g. A holder shaft 377 is rotatably supported on the partition plate 301 to be fixed to the holder cover 371 and the holder base 372. A part 378 of the holder base 372 has one end of a spring 380 retainingly engaged therewith. A part 379 of the holder plate 373 has the other end of the spring 380 retainingly engaged therewith. The holder plate 373 is urged in a direction of arrow g by a force produced by the spring 380 in a range where the pins 374 and 375 can move along the slot 376. A hole 381 is formed through a lower end wall of the holder cover 371 and allows the holder plate 373 to move.

Figure 17:
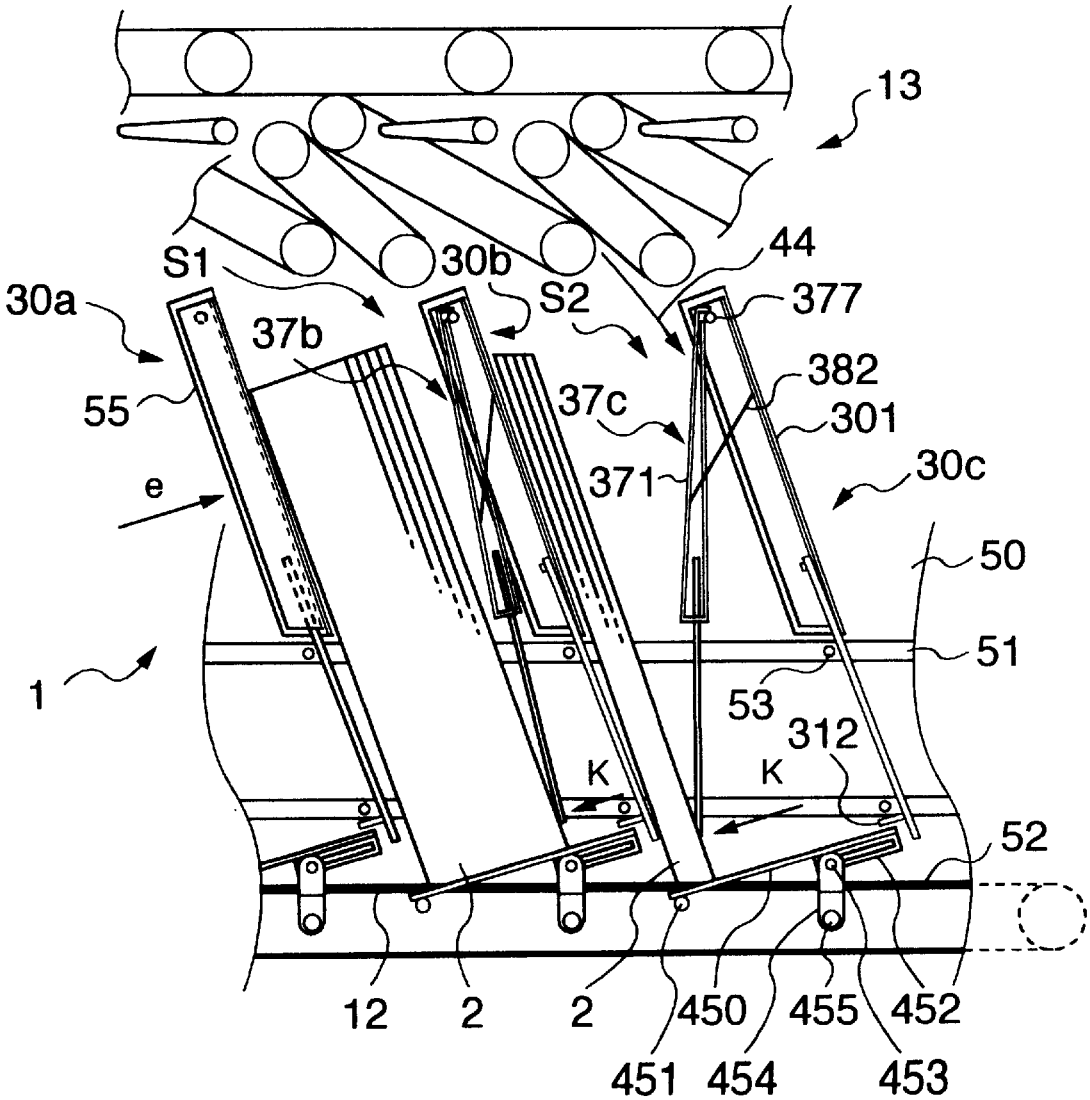
FIG. 17 is a front-elevational view showing one example of a mode changeover operation in the sheet-sorting apparatus of the invention.
Figure 18:
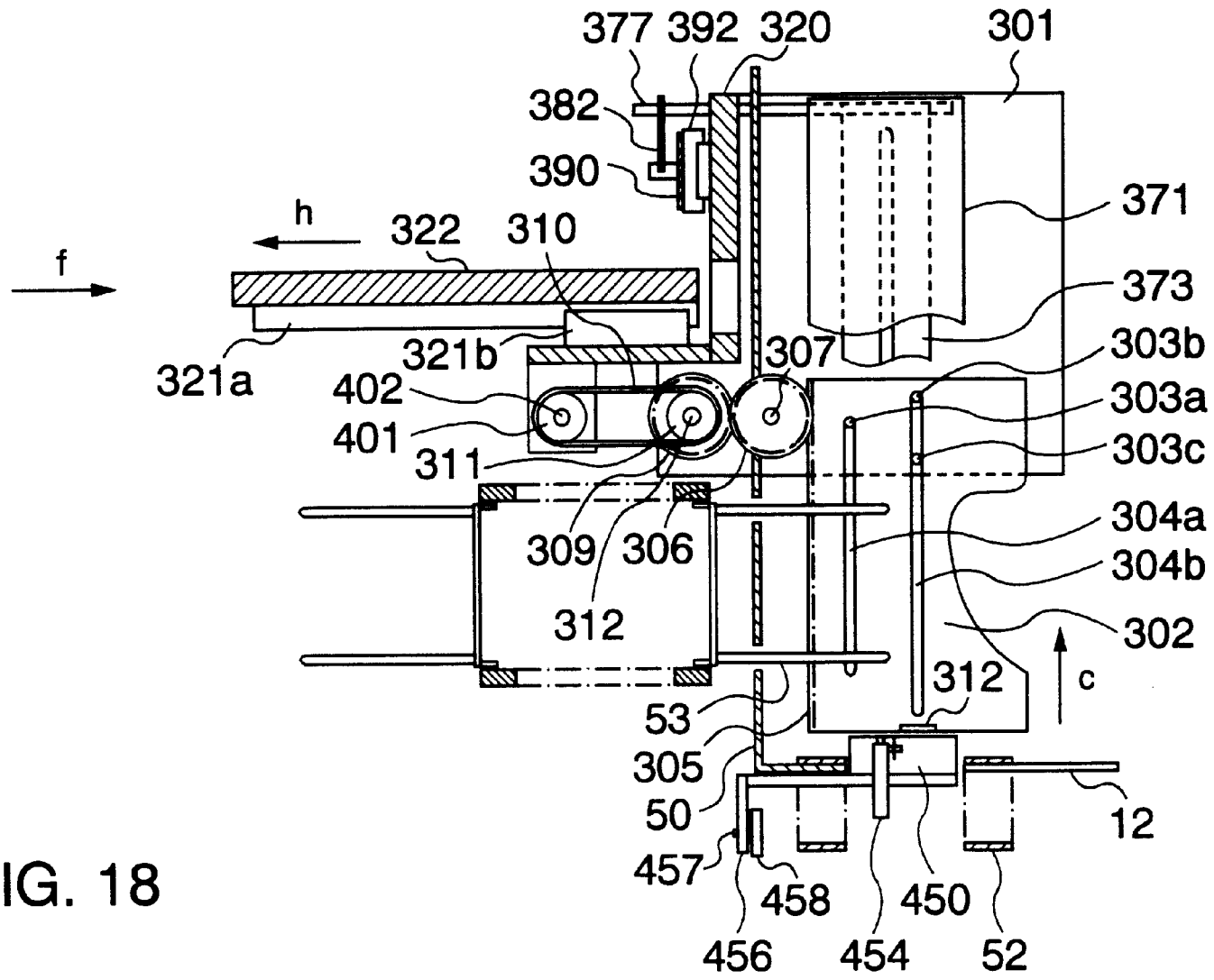
FIG. 18 is a cross-sectional view showing the mode changeover operation in the sheet-sorting apparatus of the invention.
Figure 19:
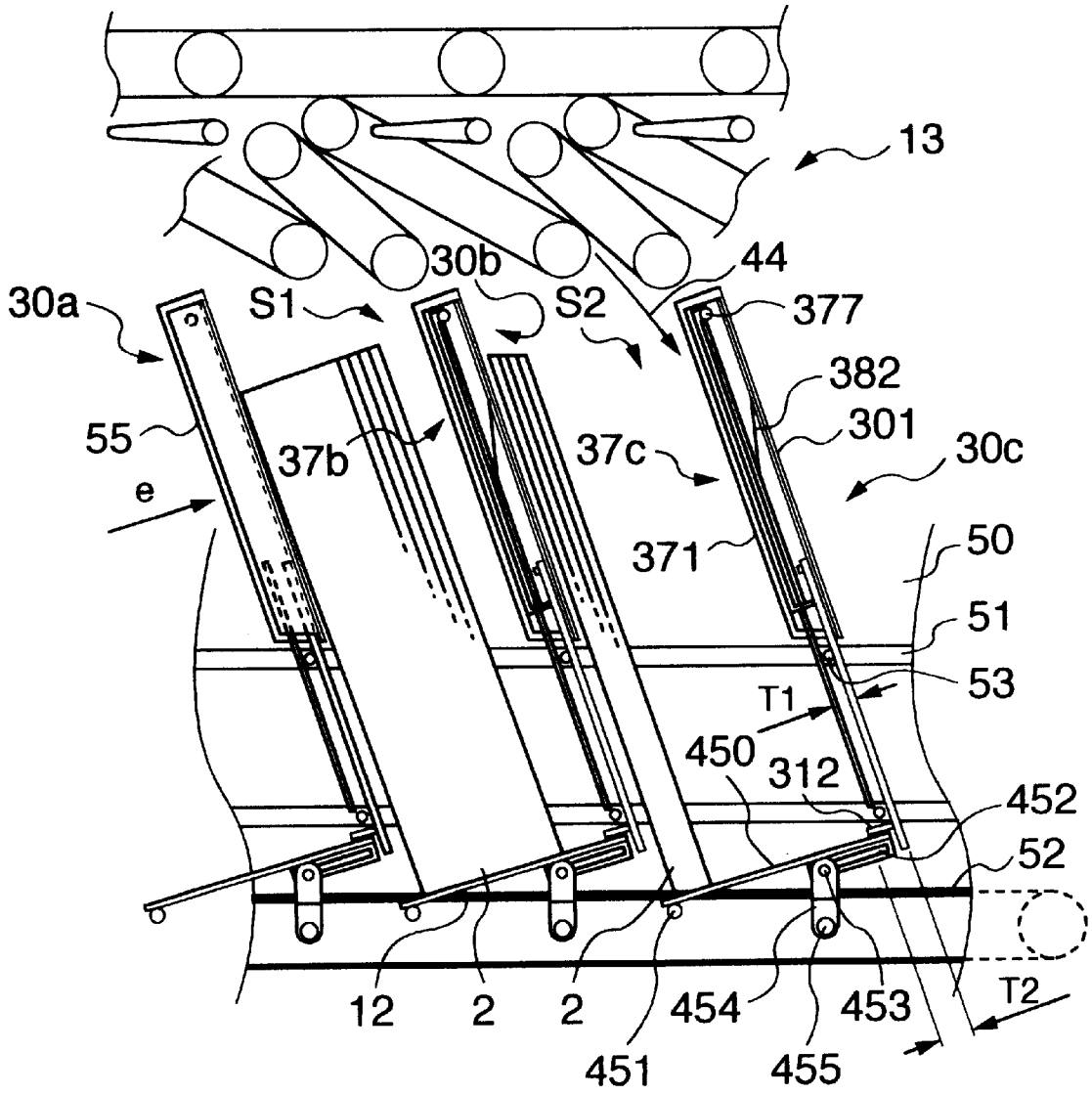
FIG. 19 is a front-elevational view showing the mode changeover operation in the sheet-sorting apparatus of the invention.
Figure 20:
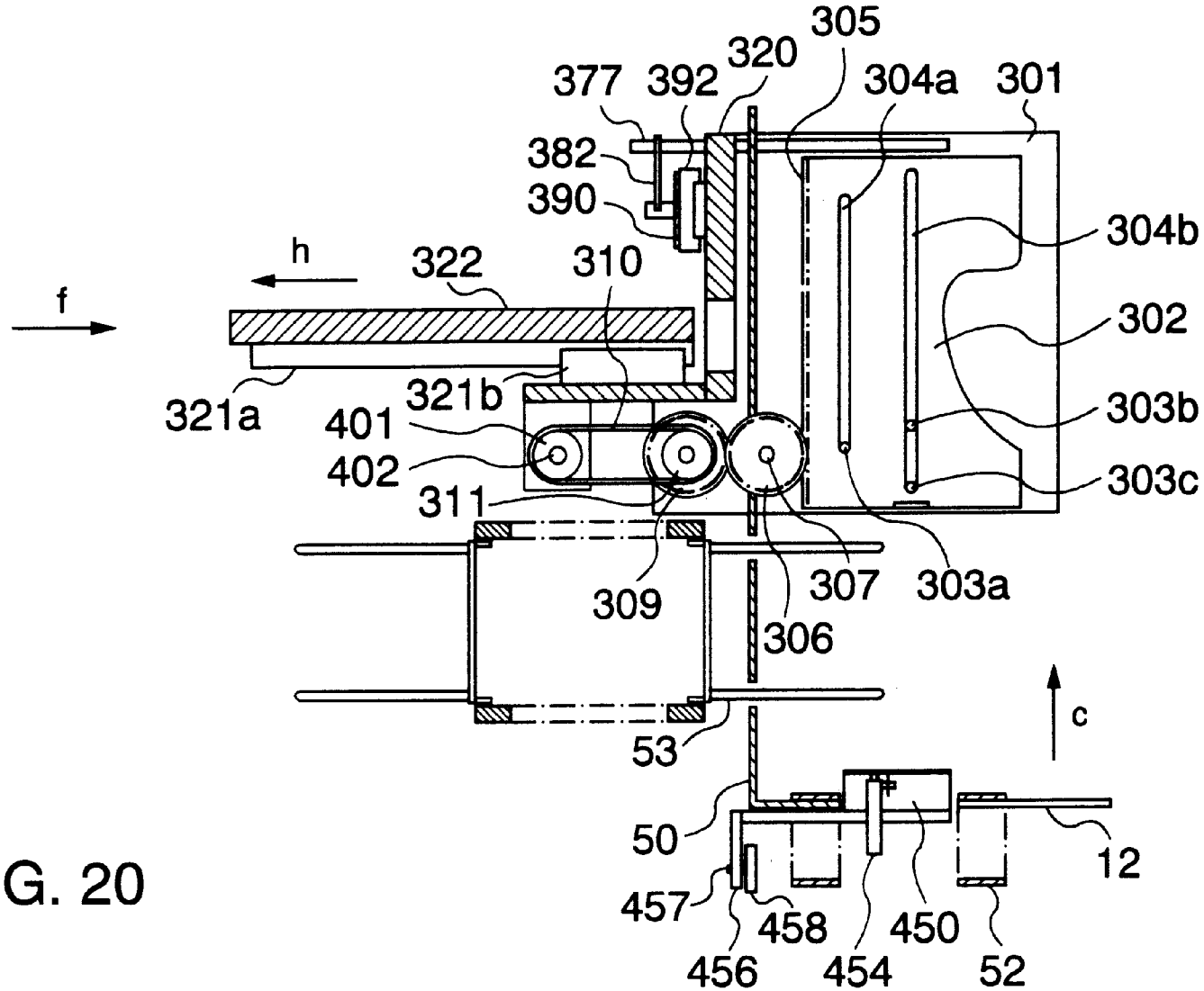
FIG. 20 is a cross-sectional view showing the mode changeover operation in the sheet-sorting apparatus of the invention.
Figure 21:
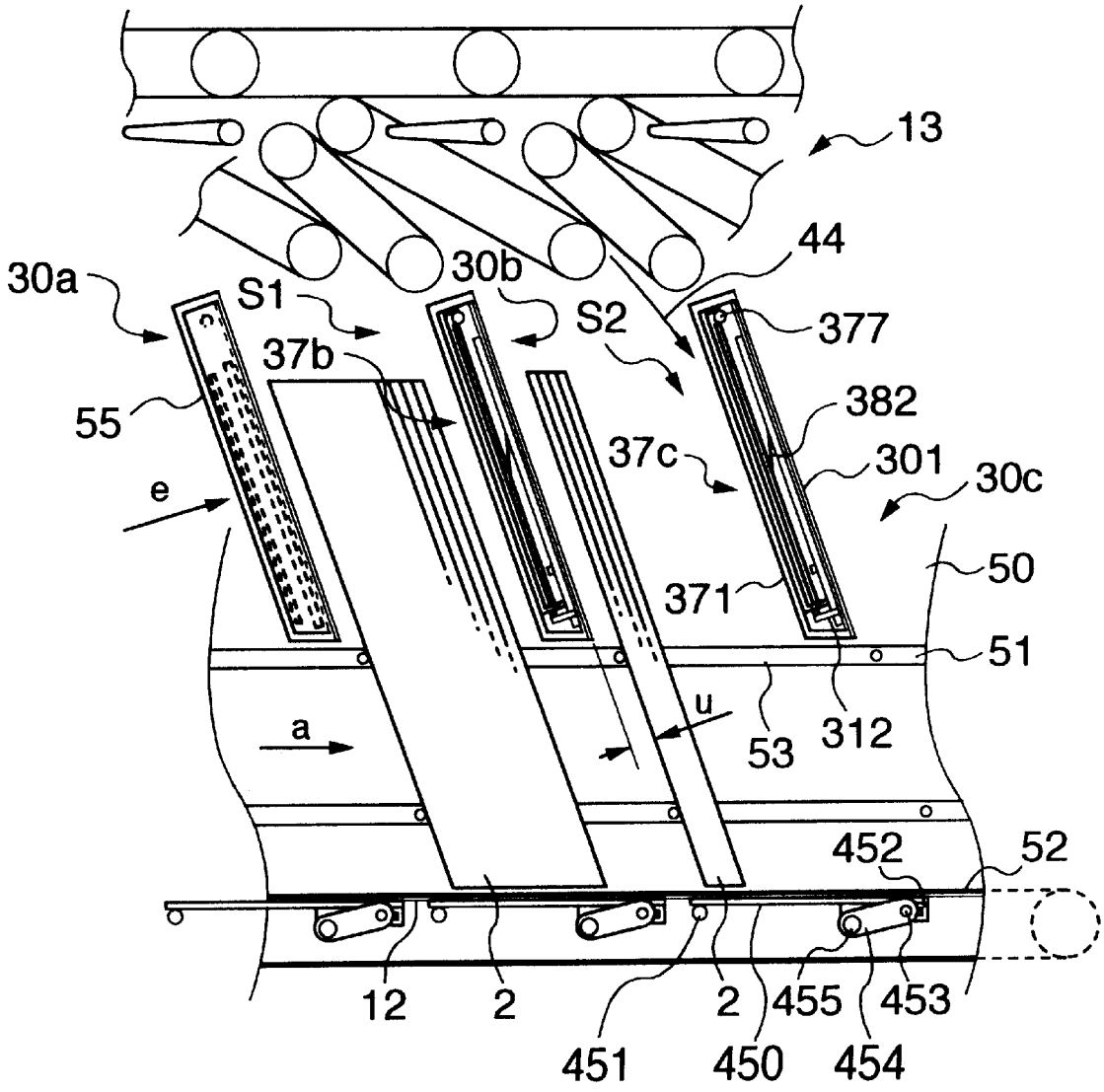
FIG. 21 is a front-elevational view showing the mode changeover operation in the sheet-sorting apparatus of the invention.
Figure 22:
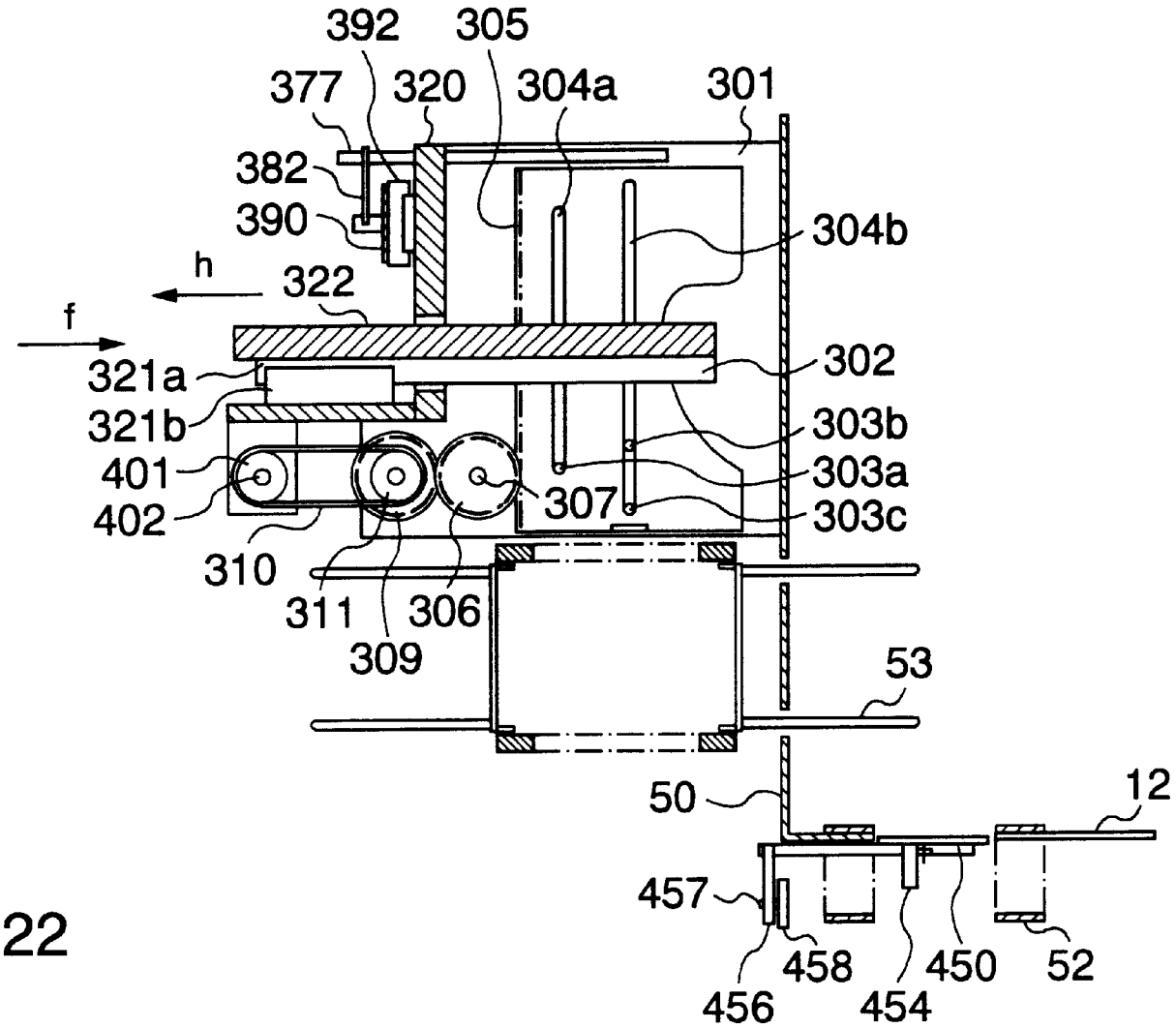
FIG. 22 is a cross-sectional view showing the mode changeover operation in the sheet-sorting apparatus of the invention.
Figure 23:
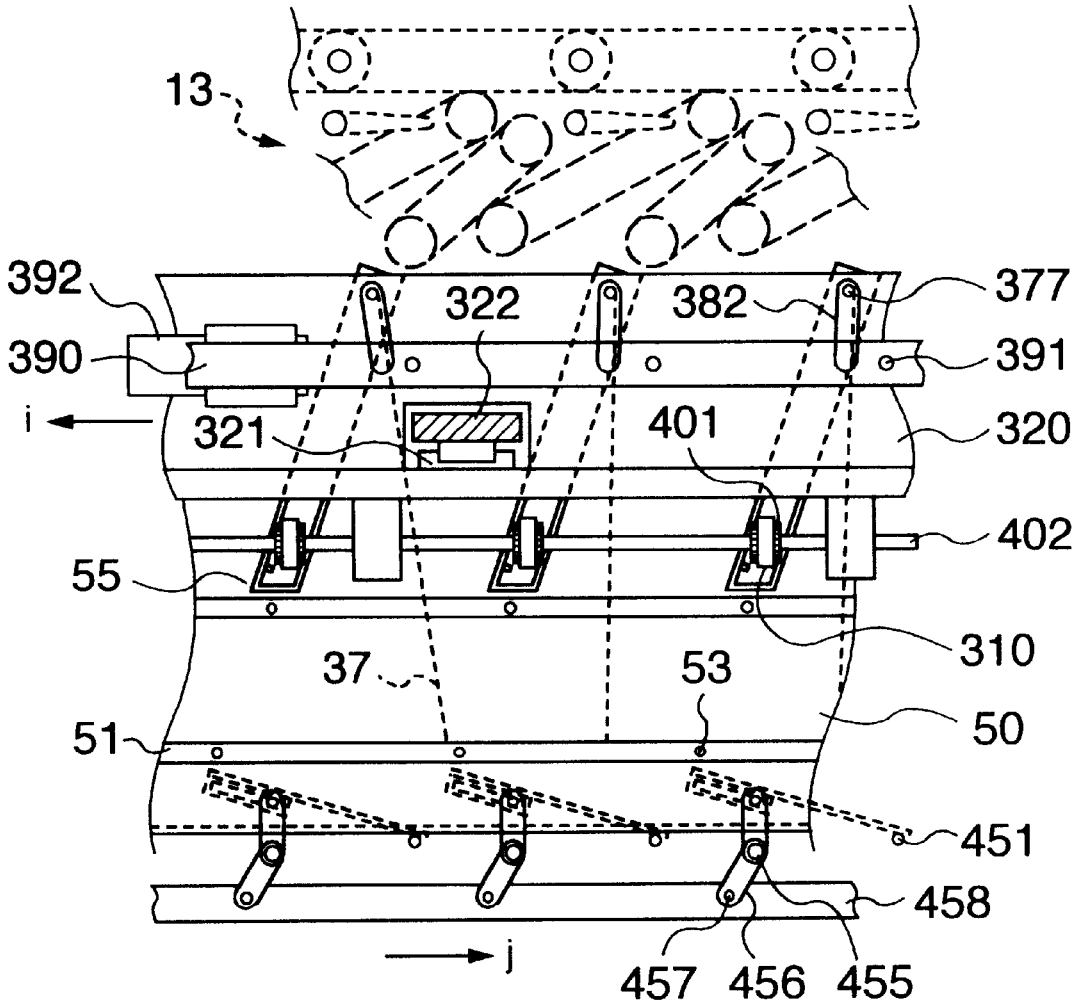
FIG. 23 is a reverse-side view showing the mode changeover operation in the sheet-sorting apparatus of the invention.
Figure 24:
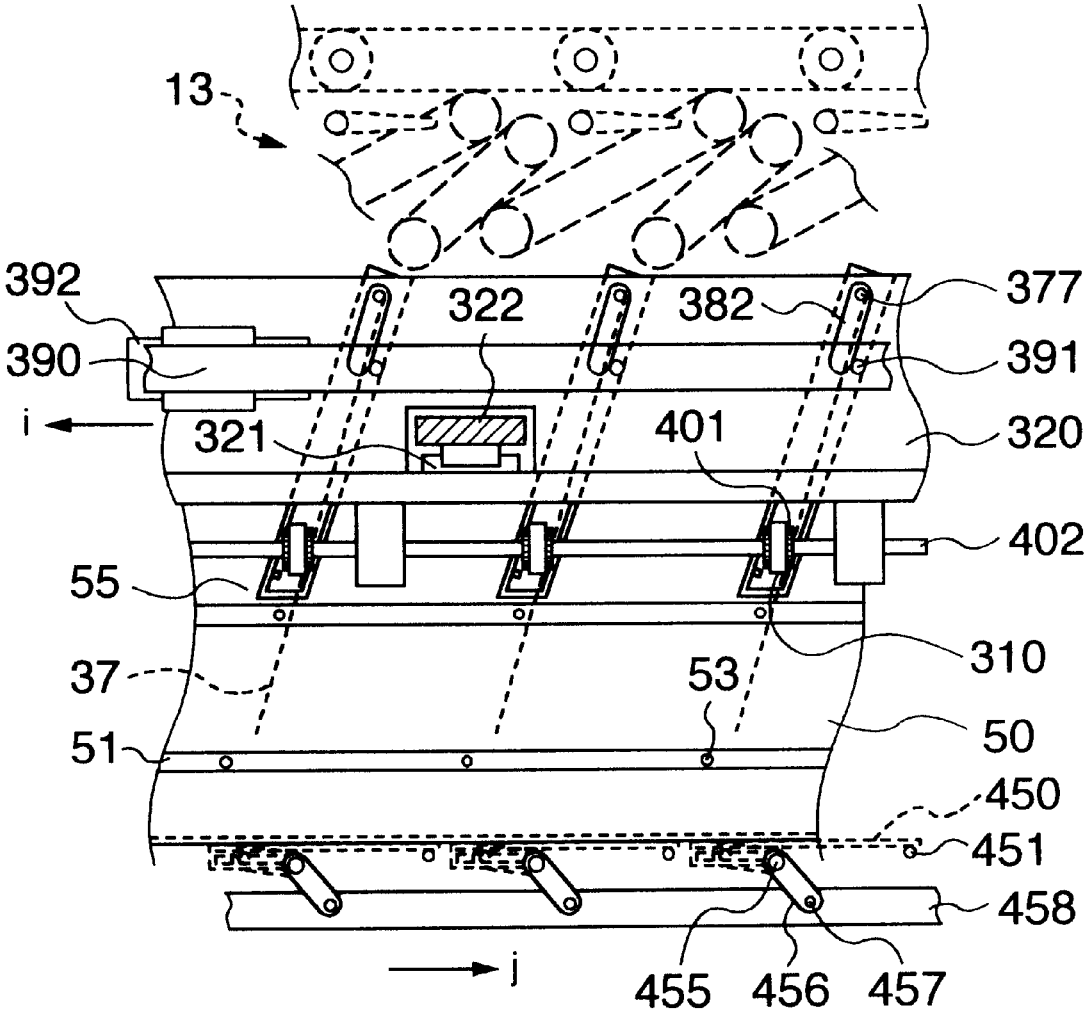
FIG. 24 is a reverse-side view showing the mode changeover operation in the sheet-sorting apparatus of the invention.

FIGS. 17, 19 and 21 are front-elevational views showing that part of the feeding and stacking means 1 which includes the stackers S1 and S2. In FIG. 17, the feeding and stacking means 1 is in the stacking mode, and the sheets or the like 2 are stacked in the respective stackers thereof. FIGS. 18, 20 and 22 are cross-sectional views of FIGS. 17, 19 and 21, respectively, as viewed in a direction of arrow e. FIGS. 23 and 24 are reverse-side views of FIGS. 18 and 22, respectively, as seen in a direction of arrow f. Here, the partitions 30*a*, 30*b* and 30*c* are constructed as described above with reference to FIGS. 12 to 14. However, for the purpose of explanation, the partitions 30*b* and 30*c* are shown with the bent portion E omitted. The holders 37*b* and 37*c* are constructed as described above with reference to FIGS. 15 and 16.

A leaf spring 382 is fixedly secured at its one end to the partition plate 301, and has the other end thereof pressing that surface of the holder cover 371, which faces the partition plate 301, with a predetermined force. With this construction, the spring 382 can produce a force to suitably push the document 2 in a direction K through a distal end of the auxiliary partition plate 302. In the stacking mode, the forks 53 are disposed between the partition 30 and the holder 37 in such a manner not to interfere with the holder 37 when the holder 37 is drawn to the vicinity of the partition 30. A stacker bottom plate 450 is supported for pivotal movement about a shaft 451, and can be angularly varied. The stacker bottom plate 450 is provided at each of the stackers. A slot 452 is formed in the stacker bottom plate 450. A link 454 (link A) is fixedly mounted on a rotating shaft 455 to be rotatable together with the rotating shaft 455. A pin 453 is fixedly secured to one end of the link A (454) to be fitted in the slot 452. When the rotating shaft 455 is rotated in a counterclockwise direction, the entire stacker bottom plate 450 is rotated counterclockwise to form a predetermined angle between it and the bottom plate 12. When the rotating shaft 455 is rotated in a clockwise direction, the entire stacker bottom plate 450 is rotated clockwise to be disposed parallel to the bottom plate 12.

Next, (1) a construction for effecting an operation of drawing the holder 37 to the vicinity of the partition 30 (as shown in FIG. 19) will be described. In FIGS. 23 and 24, an arm 382 is fixedly mounted on the holder shaft 377, and since the holder shaft 377 is fixed to the holder cover 371 and the holder base 372, so that the holder 37 is rotated as a whole when the arm 382 is rotated. A slide plate 390 is supported by a support member 392 for rectilinear movement in a direction of arrow i. Pins 391 are fixedly secured to the slide plate 390, and when the pins 391 move together with the slide plate 390 in the direction of arrow i, they are brought into contact with the arms 382 to rotate the same, thereby rotating all the holders 37 to thereby move distal ends of the holder plates 373 to the vicinity of the auxiliary partition plates 302. A link 456 (link B) is fixedly secured at its one end to the rotating shaft 455, and has a pin 457 formed at the other end thereof. The pin 457 is rotatably supported on a slide plate 458. FIGS. 21 and 24 show a state, in which the slide plate 458 is moved in a direction of arrow j, so that the stacker bottom plates 450 are disposed parallel to the bottom plate 12.

Next, (2) a construction for effecting an operation of contracting the holder 37 and the partition 30 will be described. As described above with reference to FIGS. 12 to 16, the partition 30 and the holder 37 are constructed to be retractable.

In FIG. 18, a pulley 311 is fixedly mounted on a gear 309 to train a belt 310 thereround, and the gear 309 and the pulley 311 are rotated in unison about a axis of rotation 312. The belt 310 is trained round a pulley 401 which in turn is rotated about a shaft 402. In FIG. 18, when the shaft 402 is rotated in a clockwise direction, the gear 306 is rotated counterclockwise through the belt 310, pulley 311 and the gear 309, so that the auxiliary partition plate 302 is moved in the direction of arrow c since the gear 306 is in mesh with the rack 305.

The gear 306, gear 309, the pulley 311 and the pulley 401 are provided as a set for each partition 30, and when the shaft 402 is rotated, all the pulleys 401 are rotated at the same time, thereby moving all the auxiliary partition plates 302 in the direction of arrow c. A projection 312 is formed on one side of the auxiliary partition plate 302 to project a distance T2 from the auxiliary partition plate 302, as shown in FIG. 19. When the holder 37 is moved near the partition 30, a distance between the holder plate 373 and the auxiliary partition plate 302 is T1 as shown in FIG. 19. By making T2>T1 established, when the auxiliary partition plate 302 is moved in the direction of arrow c, the projection 312 is brought into engagement with a tip end of the holder plate 373, so that the holder plate 373 is moved together with the auxiliary partition plate 302 in the direction of arrow c to be retracted. The partition 30 and the holder 37 are shown as being retracted in FIGS. 20 and 21.

Next, (3) an operation of retracting the holder 37 and partition 30 inwardly will be described. In FIGS. 18, 20 and 22, a slide base 320 is provided over the entire width of the feeding and stacking means 1, the partition plate 301 of each stacker is fixedly secured to the slide base 320, and the shaft 402 is rotatably supported on the slide base 320. A slider 321 comprises a fixing portion 321*a* and a shifter 321*b* movable along the fixing portion 321*a*. The fixing portion 321*a* is fixedly mounted on a fixed base 322, and the shifter 321*b* is fixedly mounted on the slide base 320. When the shifter 321*b* is moved in the direction of arrow h by power means such as an electric motor, the holders 37 and the partitions 30, which are fixedly or rotatably supported on the slide base 320, are moved together with the slide base 320 in the direction of arrow h. Each hole 55 formed through the inner plate 50 is a size larger than the partition plate 301, and therefore the holder 37 and the partition 30 in their drawn-in condition can be retracted inwardly of the inner plate 50, as shown in FIG. 21.

Figure 25:
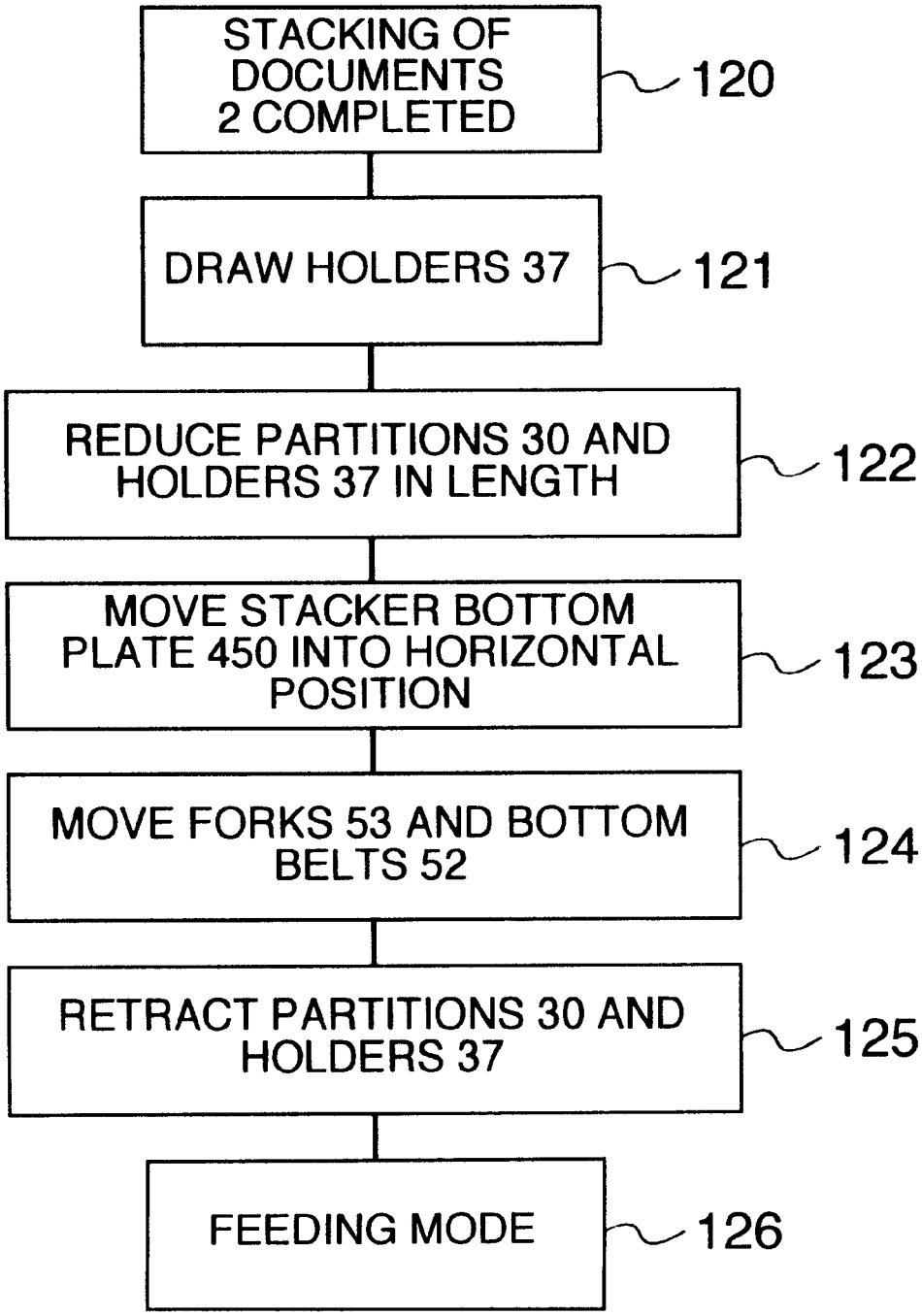
FIG. 25 is a flow chart showing one example of a mode changeover operation in the sheet-sorting apparatus of the invention.
Figure 26:
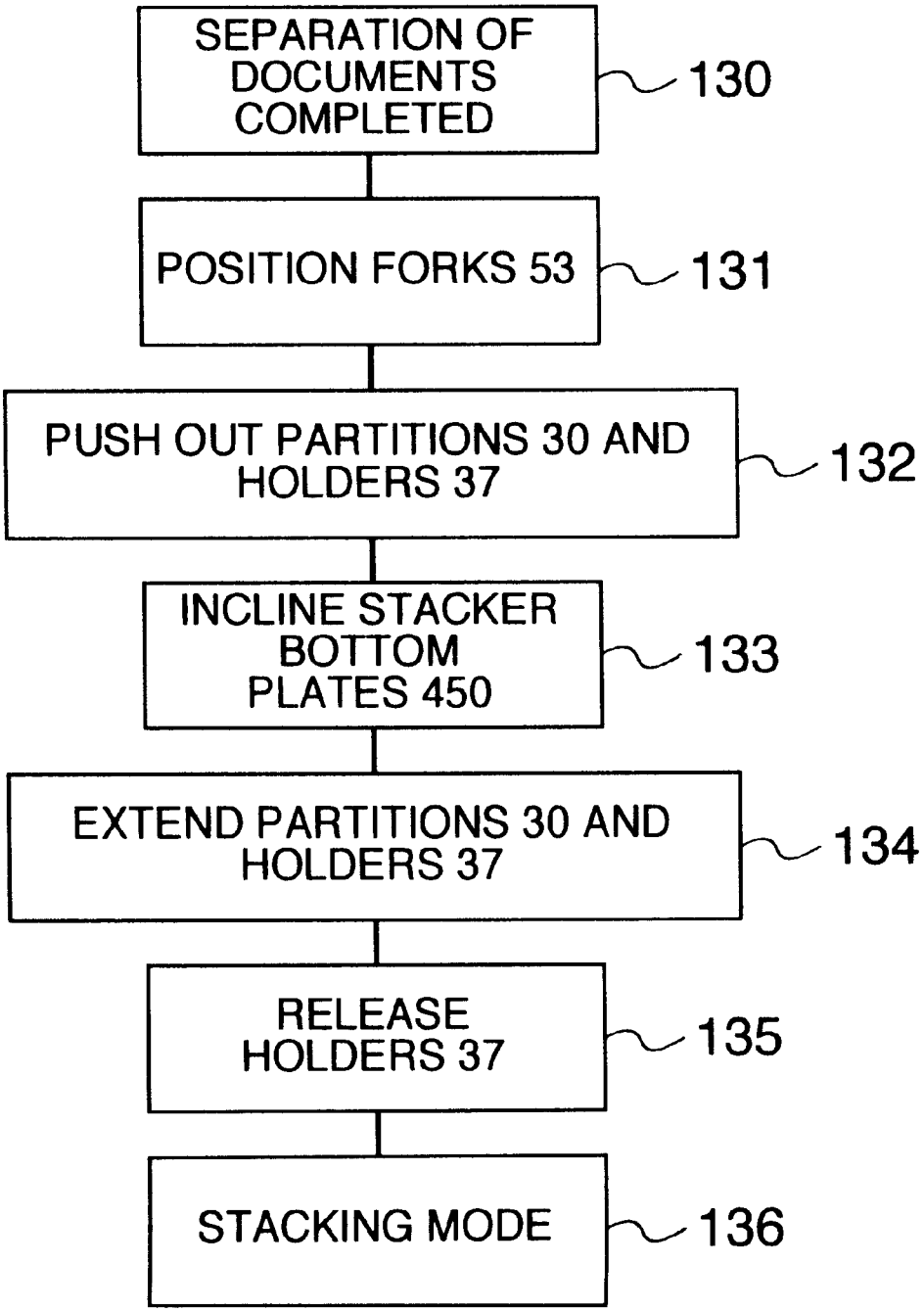
FIG. 26 is a flow chart showing the mode changeover operation in the sheet-sorting apparatus of the invention.

Next, an operation of conveying the sheets or the like, which are stacked in the respective stackers in the feeding and stacking means 1, to the singulation mechanism 4 in the above-mentioned arrangement will be described with reference to FIGS. 17 to 24 and flow charts of FIGS. 25 and 26. First, with reference to the flow chart of FIG. 25, description will be made of an operation of conveying the sheets or the like 2, which are stacked in the stackers S1, S2 . . . of the feeding and stacking means 1, to the singulation mechanism 4 after the feeding and stacking means 1 is switched from the stacking mode to the feeding mode.

First, when all the sheets or the like 2 in the feeding and stacking means 1 placed in the stacking mode have been sorted (Step 120), the slide plate 390 is moved in the direction of arrow i as shown in FIGS. 23 and 24, so that the pins 391 press the respective arms 382 to rotate the respective holders 37, thereby moving the holders 37 toward the respective partitions 30 (Step 121). This state is shown in FIG. 19. Then, the shaft 402 is rotated clockwise in FIG. 18 to move the partitions 30 and holders 37 in the direction of arrow c, thereby making them in length (Step 122). This state is shown in FIG. 20. Then, the slide plate 458 is moved in a direction of arrow j to rotate the shafts 455 and the links 454 counterclockwise in FIGS. 23 and 24, so that the bottom plates 450 of the stackers are pivotally moved clockwise about the shaft 451 in FIG. 19, and are made parallel to the bottom plate 12, that is, substantially horizontal (Step 123). This state is shown in FIG. 21. Then, the forks 53 and the bottom belts 52 are moved in the direction of arrow a to form a gap u between a stack of sheets or the like 2 and the associated partition 30 (Step 124). In this manner, the sheets or the like 2 are prevented from being accidentally drawn inwardly together with the partition 30 and the holder 37 when the partition 30 and the holder 37 which have already been made small in length in Step 122 are inwardly retracted. Then, in FIG. 22, the shifter 321*b* of the slider 321 is moved in the direction of arrow h to inwardly retracting the partitions 30 and the holders 37 which are fixedly or rotatably mounted on the slide base 320 (Step 125).

In the operations so far, the partitions 30 and the holders 37 have been retracted inwardly of the inner plate 50 and also the sheets or the like 2 have been supported by the forks 53 and the bottom belts 52, and so that movements of the bottom belts 52 and the forks 53 in the direction of arrow a enable feeding the sheets or the like 2 to the singulation means 4 located at the end of the feeding and stacking means 1. Namely, the feeding and stacking means 1 is switched into the feeding mode (Step 126). The forks 53 are supported, for example, on a chain or a belt (not shown) to move to the back side of the inner plate 50 after conveying the sheets or the like 2 to the singulation means 4, and again appear to the sheet-stacking side from the end of the feeding and stacking means 1 opposite to the singulation means 4.

Next, with reference to the flow chart of FIG. 26, description will be made of the operation of switching the feeding and stacking means 1 from the feeding mode to the stacking mode after the feeding and stacking means 1 place in the feeding mode have fed all the sheets or the like 2 to the singulation mechanism 4 to permit the same to be separated by the singulation mechanism 4. When all the sheets or the like 2 have been separated and no sheet 2 is present in the feeding and stacking means 1 (Step 130), the forks 53 are moved between the partitions 30 and the holders 37 as shown in FIG. 19 to thereby be positioned (Step 131). Then, in FIG. 22, the shifter 321*b* of the slider 321 is moved in the direction of arrow f to push the partitions 30 and the holders 37, which are fixedly or rotatably supported on the slide base 320, out of their retracted positions located inwardly of the inner plate 50 (Step 132). This state is shown in FIG. 20. Then, the slide plate 458 is moved in the direction of arrow i in FIGS. 23 and 24 to rotate the shafts 455 and links 454 clockwise in FIGS. 23 and 24, so that the stacker bottom plates 450 are pivotally moved about the shaft 451 counterclockwise in FIG. 19 to be inclined at a predetermined angle relative to the bottom plate 12 (Step 133). Then, the shaft 402 is rotated counterclockwise in FIG. 18 to move the partitions 30 and the holders 37 in a direction opposite to the direction of arrow c to thereby extend them (Step 134). Then, the slide plate 390 is moved in the direction of arrow j as shown in FIGS. 23 and 24, so that the arms 382 are released from the pins 391, respectively (Step 135), and as a result the sheets or the like 2 can be stacked along the partitions 30 as shown in FIG. 17. Namely, the feeding and stacking means 1 is switched to the stacking mode (Step 136). However, this state differs from the state of FIG. 17 in that there is no sheet 2 present in the feeding and stacking means 1 since the stacking of the sheets or the like 2 has not yet been started. It is not always necessary to prosecute Step 133 in the order shown in FIG. 26, and for example, Step 133 may be prosecuted before Step 131 or after Step 135, or may be prosecuted simultaneously with any one of Steps 131 and 135.

Figure 27:
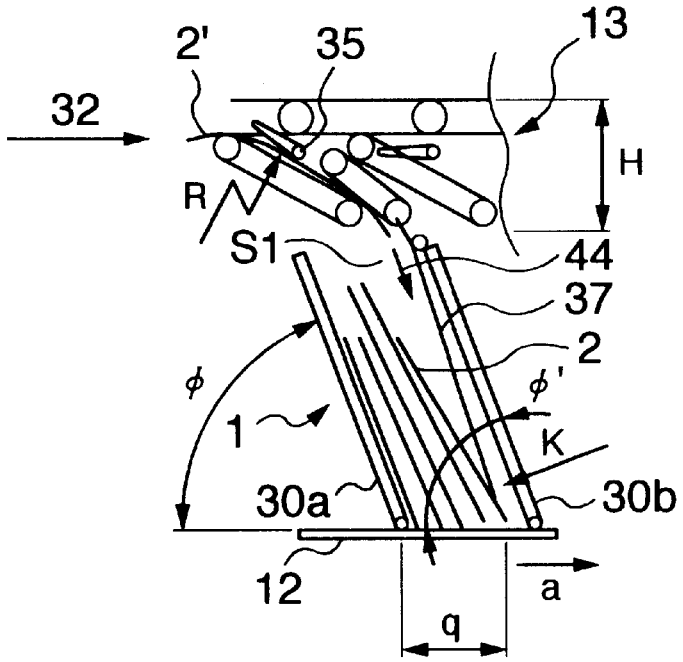
FIG. 27 is a front-elevational view showing a front-elevational view of the construction of one example of feeding and stacking means in the sheet-sorting apparatus of the invention.
Figure 28:
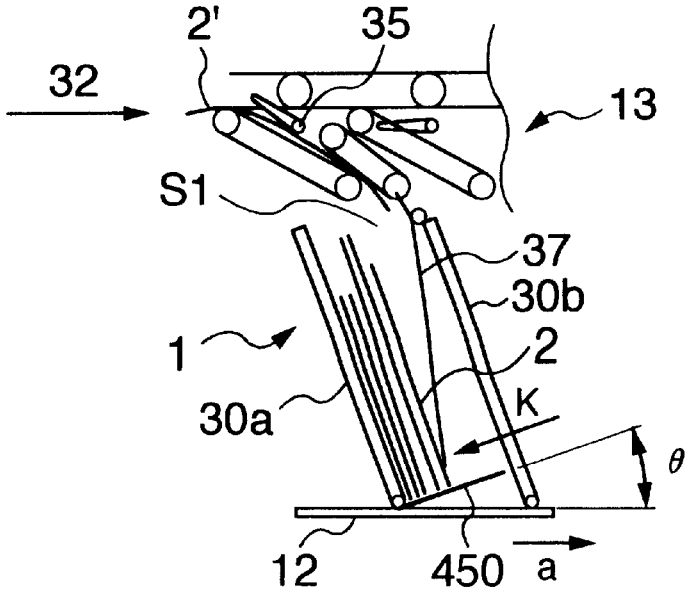
FIG. 28 is a front-elevational view showing a front-elevational view of the construction of another example of feeding and stacking means in the sheet-sorting apparatus of the invention.

Effects in inclining the stacker bottom plates 450 as shown in FIG. 17, will be described with reference to FIGS. 27 and 28. FIGS. 27 and 28 show a construction of one of the stackers of the stacking means 1. The posture of the sheets or the like 2, sorted and stacked in the stacker S1 by the first distributing means 13 as described above with reference to FIG. 3, is shown. The partition 30 of each of the stackers is not perpendicular to the bottom plate 12, but is inclined, for example, at an angle f of 70° relative to the bottom plate 12. One reason for this is that the sheets or the like 2', conveyed in a direction of arrow 32 by the first distributing means 13 must be turned (or curved) toward and guided into the corresponding stacker by the gate diverter 35. At this time, if the partition 30 is perpendicular to the bottom plate 12, a direction, indicated by arrow 44, of introduction of the sheets or the like into the stacker should be rendered substantially perpendicular to the bottom plate 12. On the other hand, the sheets or the like 2' to be conveyed may be relatively rigid, and therefore a radius R of curvature can not be made smaller than about 200 mm, so that a height H of the first distributing means 13 should be increased, which results in an increase in a height of the apparatus.

Besides, if the partition 30 is made perpendicular to the bottom plate 12, upper edge portions of the stacked sheets or the like 2 may tilt rightward in FIG. 27 to strike against a leading edge of a subsequent sheet 2' charged in a direction of arrow 44, thus causing jamming. To avoid such a situation, preferably, the partition 30 is inclined, for example, at an angle f of 70° so that leading edges of sheets or the like 2' charged can fall leftward to lean on the partition 30 in FIG. 27. With this construction, it is not necessary to increase the height H of the first distributing means 13, and the apparatus can be made compact.

However, there is a problem with such a construction. In FIG. 27, a leading edge of the sheet 2' charged advances along the partition 30 or the sheets or the like 2, and then strikes on the bottom plate 12. At this time, an angle, at which the sheet 2' strikes on the bottom plate 12, is not a right angle, but corresponds to an inclination angle f (=70°) of the partition 30. Assuming that the sheets or the like 2 is conveyed, for example, at a speed of about 3 m/s, leading edges of the sheet s or the like 2 slide along the bottom plate 12 or rebounds in the direction of arrow a when the sheet 2 strikes on the bottom plate 12. Therefore, a thickness q of the leading edges of the stacked sheets or the like 2 along the bottom plate 12 increases to become larger than the total thickness of the sheets or the like 2. This results in a problem that when only several sheets or the like are stacked in the stacker, the latter becomes full.

A construction for avoiding this problem will be described with reference to FIG. 28. A stacker shown in FIG. 28 differs from that shown in FIG. 27 only in that the former is provided with a stacker bottom plate 450 inclined at an angle of θ relative to a horizontal. In the construction shown in FIG. 28, given $\phi=70°$ and $\theta=20°$, a leading edge of the sheet 2' advancing along the partition 30 or the sheets or the like 2 having been stacked strikes on the stacker bottom plate 450 substantially at a right angle. Therefore, in the case shown in FIG. 28, the sheets or the like 2, when striking on the stacker bottom plate 450, merely rebounds at a right angle with respect to the stacker bottom plate 450, that is, in parallel relation to the partition 30 or the sheets or the like 2 having been stacked. Thus the sheets or the like 2 are favorably arranged in order along the partition 30 as shown in FIG. 28, and therefore there is not encountered a disadvantage that the thickness q of the leading edges of the stacked sheets or the like increases as described above with reference to FIG. 27. Here, if a sum of φ and θ is less than 90 °, an effect of preventing an increase in the thickness of the leading edges of the sheets or the like, which has been described for FIG. 28, becomes less. For example, given $\phi=70°$, the leading edges of the sheets or the like may slide with $\theta=10°$. θ is preferably not less than 15°, and more preferably not less than 20°, and then sliding of the leading edges of the sheets or the like is prevented, so that the sheets or the like can be suitably stacked in the stacker.

Figure 29:
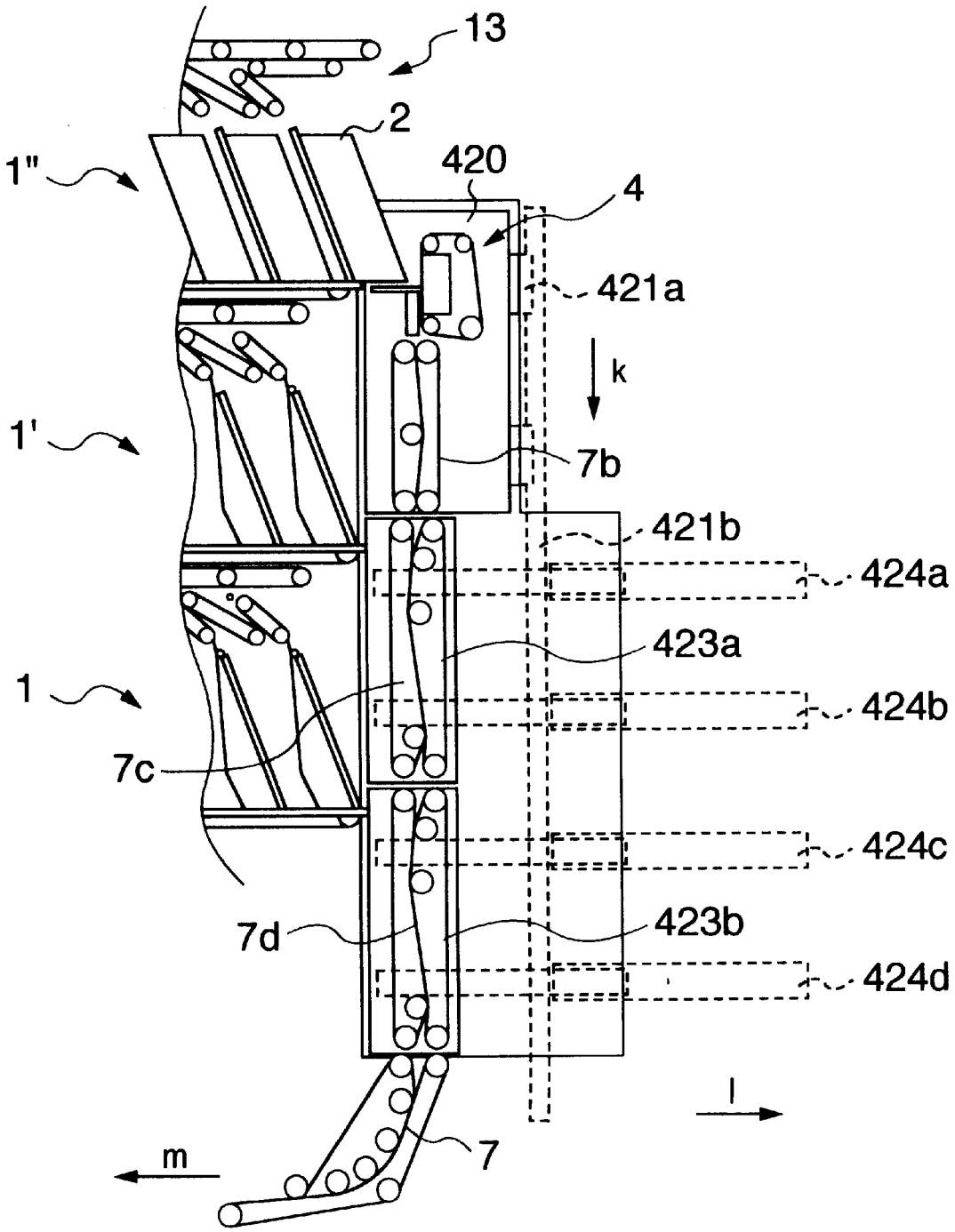
FIG. 29 is a front-elevational view showing an example of singulation means moving means in the sheet-sorting apparatus of the invention.
Figure 30:
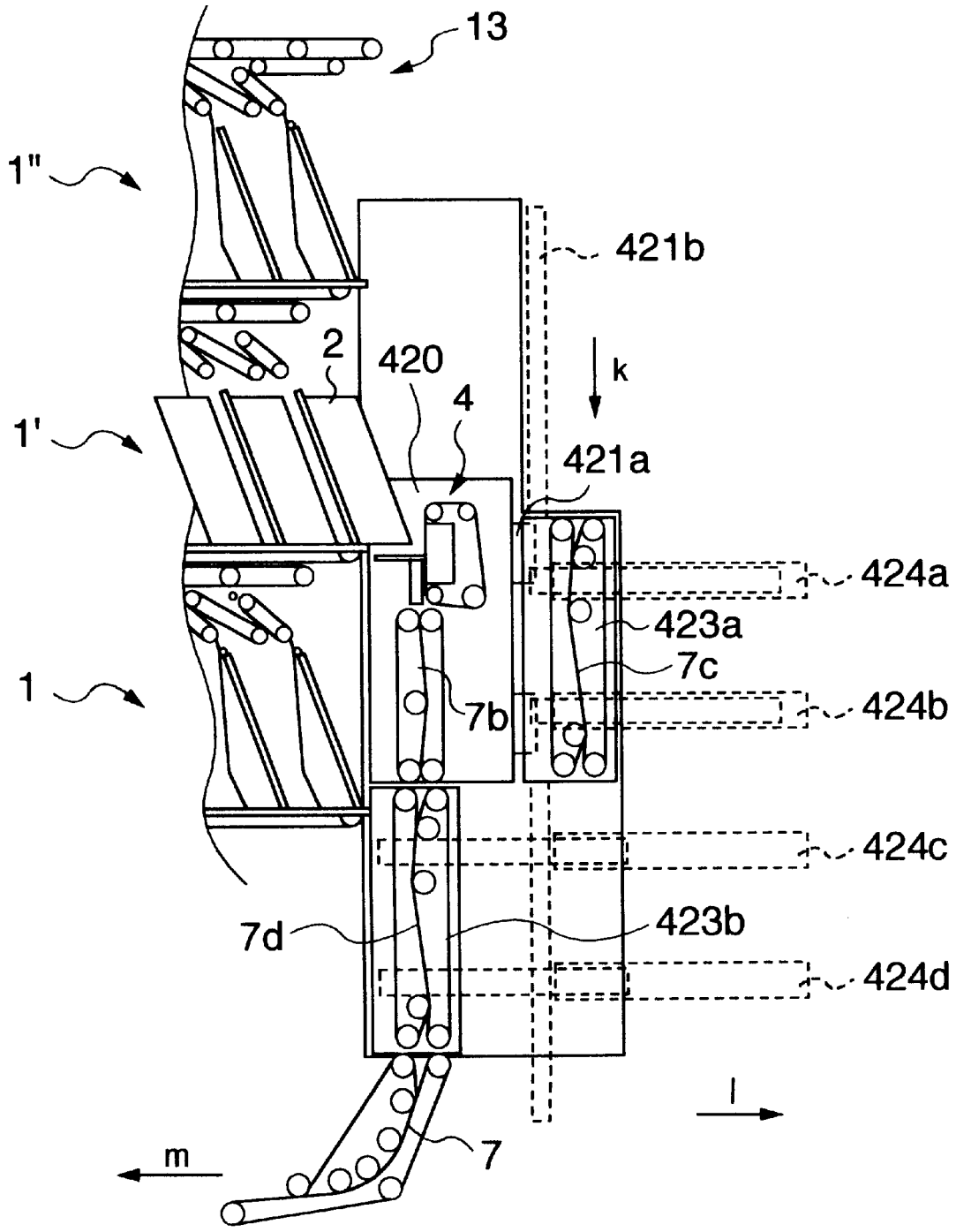
FIG. 30 is a front-elevational view showing a modified singulation means moving means in the sheet-sorting apparatus of the invention.
Figure 31:
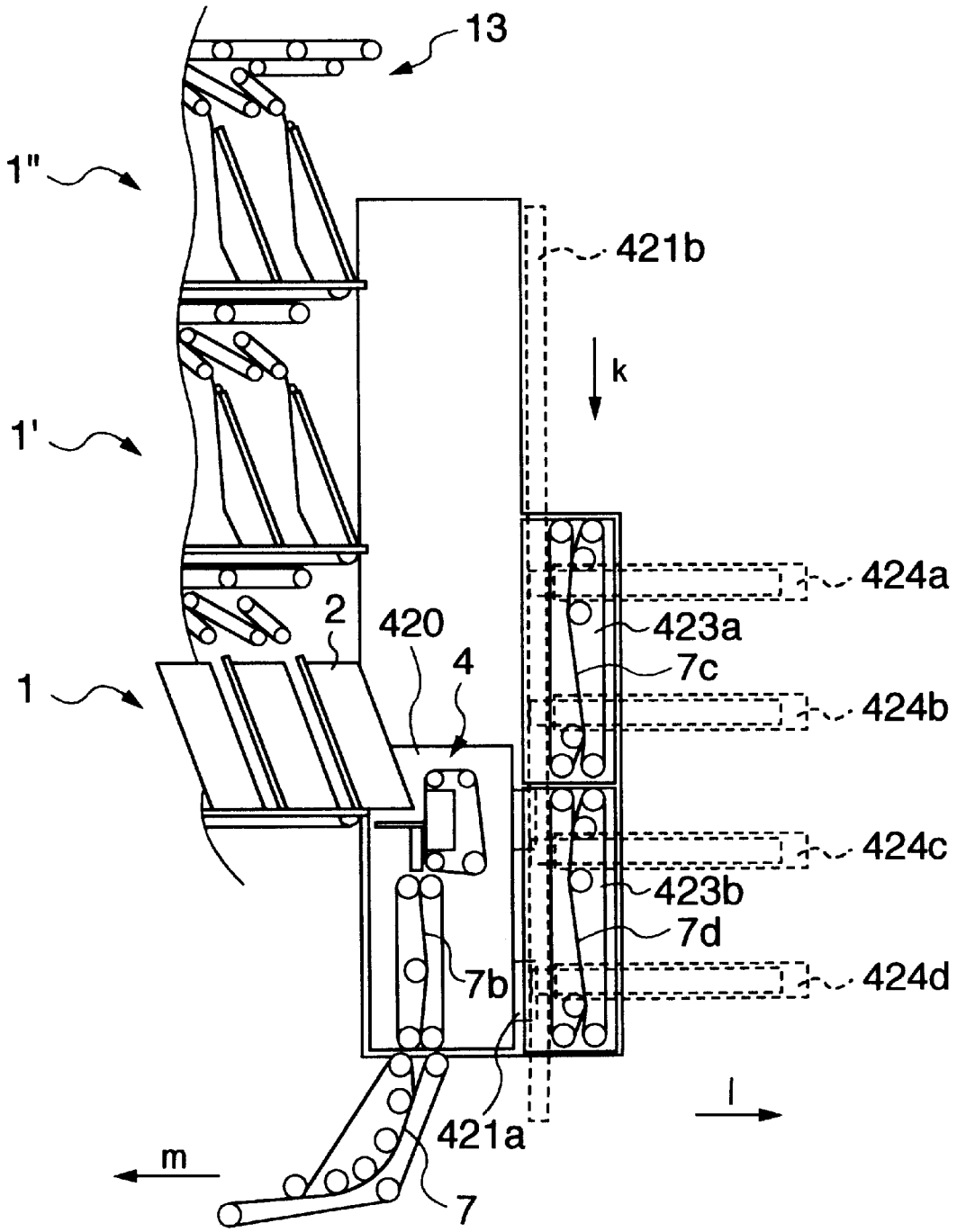
FIG. 31 is a front-elevational view showing the above modified singulation means moving means.

Next, another embodiment of the present invention will be described with reference to FIGS. 29 to 31. FIGS. 29 to 31 show only a construction in the vicinity of the singulation means 4 of the feeding and stacking means 1 of the sheet-sorting apparatus shown in FIG. 1, and a construction except for the construction shown in FIG. 1 is similar to that shown in FIG. 1. The embodiment of FIGS. 29 to 31 differs from the embodiment of FIG. 1 in that only one singulation means 4 is provided while the three singulation means 4 are provided for the three feeding and stacking means in FIG. 1, respectively, and that there is provided means for moving the singulation means 4 from one feeding and stacking means to another. Namely, during the operation, only one of the feeding and stacking means is in the feeding mode, so that the singulation means is adapted to be moved to the feeding and stacking means in the feeding mode.

In FIG. 29, third feeding and stacking means 1" is in the feeding mode, and the singulation means 4 is located in an upper stage position. The singulation means 4 is mounted on a singulation base 420, and a conveying path 7*b* is provided on the singulation base 420. A vertical slider 421 has a shifter 421*a* which is movable along a fixing portion 421*b* in a direction of arrow k. The shifter 421*a* is mounted on the singulation base 420 to be moved in the direction of arrow k by drive means (not shown) such as an electric motor. Conveying connection means 423*a* is mounted on horizontal sliders 424*a* and 424*b*, and also conveying connection means 423*b* is mounted on horizontal sliders 424*c* and 424*d*, and these conveying connection means 423*a* and 423*b* are adapted to be moved in a direction of arrow 1 by drive means (not shown) such as an electric motor. The conveying connection means 423*a* and 423*b* have conveying paths 7*c* and 7*d*, respectively, and the sheets or the like 2 separated one by one by the singulation means 4 are conveyed sequentially through the conveying paths 7*b*, 7*c* and 7*d* to a conveying path 7 in the direction of arrow k, so that the sheets or the like can be conveyed in a direction of arrow m.

Next, description will be made of an operation of moving the singulation means 4 from the third feeding and stacking means 1" to second feeding and stacking means 1' disposed at an intermediate stage. In FIG. 29, the horizontal sliders 424*a* and 424*b* are first actuated to move the conveying connection means 423*a* in a direction of arrow 1. Then, the vertical slide 421 is actuated to move the singulation base 420 in the direction of arrow k into registry with the second feeding and stacking means 1' disposed at the intermediate stage. This state is shown in FIG. 30. At this time, the second feeding and stacking means 1' is in the feeding mode, and the singulation means 4 separates the sheets or the like 2 one by one and conveys them sequentially through the conveying paths 7*b* and 7*d* to the conveying path 7 in the direction of arrow k, so that the sheets or the like can be conveyed in the direction of arrow m.

Next, description will be made of an operation of moving the singulation means 4 from the second feeding and stacking means 1' to first feeding and stacking means 1 disposed at a lower stage. In FIG. 30, the horizontal sliders 424*c* and 424*d* are first actuated to move the transport connection means 423*b* in the direction of arrow 1. Then, the vertical slider 421 is actuated to move the singulation base 420 in the direction of arrow k into registry with the first feeding and stacking means 1 disposed at the lower stage. This state is shown in FIG. 31. At this time, the first feeding and stacking means 1 is in the feeding mode, and the singulation means 4 separates the sheets or the like one by one by and conveys them through the conveying path 7*b* to the conveying path 7 in the direction of arrow k, so that the sheets or the like can be conveyed in the direction of arrow m.

By reversing the above procedures, the singulation means 4 can be moved from the feeding and stacking means 1 at the lower stage to the second feeding and stacking means 1' or to the third feeding and stacking means 1" in a direction opposite to the direction of arrow k.

Thus, the singulation means 4 can be moved as described above so as to separate the sheets or the like 2 in one among the first to third feeding and stacking means 1 to 1", which are in the feeding mode. The separated sheets or the like 2 are processed in a similar manner as described above for the embodiment of FIG. 1.

In the embodiment of the invention, each of the feeding and stacking means has a plurality of (for example, 16) stackers, and sorting can be performed times corresponding to the total number of the stackers in the stacking mode, and also by switching the feeding and stacking means to the feeding mode, the sheets or the like stacked in the plurality of stackers can be separated one by one in the order of stacking by a single singulation means. Therefore, the number of the singulation means is equal to that of the feeding and stacking means, and the apparatus is made simple in construction as compared with a construction, in which a singulation means is provided for each stacker. Besides, if the singulation means is designed to be movable, only one singulation means suffices, and the construction of the apparatus is further simplified.

In the embodiment of the invention, a sorting machine of a small size including the feeding and stacking means having a width of about 2 m is used to enable sequencing the sheets or the like (for example, mail) having a sorting information indicated thereon, in the order represented by the sorting information. For example, the sorting information represent addresses, to which mail is to be delivered, is arranged in accordance with the carrier route of the mail to enable sequencing the fed mail in accordance with the carrier route.

The plurality of feeding and stacking means are vertically arranged one upon another, and therefore an overall width of the apparatus is at most about 3 m, so that the apparatus can be installed even in a post office of a relatively small scale. When the feeding and stacking means is switched from the stacking mode to the feeding mode, the sorted mail can be repeatedly sorted without the need of manual labor, and the carrier route sequencing operation of mail can be automatically effected.

When the fed sheets or the like, for example, mail, are to be sorted repeatedly several times to be sequenced in a predetermined order, it is only necessary to switch an operation between the feeding mode and the stacking mode since the stacking means also serves as the feeding means. It is not necessary to transfer sheets or the like, having been sorted, from a stacking section to a feeding section, and therefore the burden on a worker is reduced, whereby the processing can be carried out at high speed.

The sheets or the like, for example, mail, having a sorting information indicated thereon, can be sequenced in the order represented by the sorting information to enhance an efficiency of the carrier route sequencing operation of mail. Besides, a width of the feeding section and stacking section is in the range of about 2 m, so that a worker suffices to move only slightly to reach the feeding section and stacking section. Therefore, the burden on a worker is reduced to improve the environment of labor.

In the above embodiments, one singulation means is provided for each feeding and stacking means or the plurality of feeding and stacking means to attain miniaturization. When miniaturization is not particularly problematic, each feeding and stacking means may be designed to be top-fed and bottom-discharge, so that the sheets or the like are vertically stacked one upon another in each stacker and singulation means is provided at the bottom portion of each stacker. Even with this construction, a carrier route sequencing performance will not be affected. However, there is a disadvantage that since a conveying path must extend from a lower portion of one feeding and stacking means to an upper portion of another feeding and stacking means, conveying paths become complicated in the case where there are provided three or more feeding and stacking means.

As described above, in the present invention, each sorting shelf is made to have functions of a feeder and a stacker, and when any one of the sorting shelves serves as a hopper, the sheets or the like can be fed to other sorting shelves serving as a stacker. Accordingly, the stacked sheets or the like can be sequenced while prevented from dropping.

The partitions of the sorting shelves are retractable, so that the sheets or the like sorted and stacked in the plurality of stackers can be separated by the singulation means provided for each sorting shelf. Therefore, there can be provided a sheet-sorting apparatus of small size, in which the carrier route sequencing operation of the sorted mail can be effected and which eliminates the need of the singulation means for each stacker.

What is claimed is:

1. Apparatus for sorting sheet-like items such that an order of said sheet-like items is changed a plurality of times in accordance with information applied to said sheet-like items to thereby be sequenced in a desired order; said apparatus comprising:

a plurality of sorting shelves, in which said sheet-like items are divided into groups by partitioners in said sorting shelves and sorted by said sorting shelves, and said sorting shelves comprise means for retracting said partitioners;

conveying means for conveying said sheet-like items between said sorting shelves while sorting said sheet-like items separated from one another into another sorting shelf; and means for conveying said sheet-like items stacked in one of said sorting shelves, in which a respective partition of said partitioners is retracted, to another sorting shelf, in which said partitioners is held in place.

2. Apparatus according to claim 1, further comprising means for moving the stacked said sheet-like items to one end of said sorting shelf, and said sheet-like items are supported on said moving means before said partition is retracted.

3. Apparatus for sorting sheet-like items, comprising:

a plurality of feeding and stacking means each having a plurality of stackers for sorting and stacking a plurality of said sheet-like items therein, each of said feeding and stacking means having a stacking mode, in which said sheet-like items are distributed and charged into said respective stackers, and a feeding mode, in which said stacked sheet-like items are separated one by one to be discharged;

reading means for reading information applied to said separated sheet-like items;

conveying means for conveying said separated sheet-like items to another of said feeding and stacking means; and distributing means provided with every said feeding and stacking means for distributing and charging said conveyed sheet-like items into said respective stackers;

said feeding and stacking means are placed in the stacking mode such that partition plates, which serve to partition the interior of said feeding and stacking means into said plurality of stackers, and a plurality of holder means, which serve to hold the sorted and stacked said sheet-like items, and are placed in the feeding mode such that said partition plates and said holder means are retracted from a region where said sheet-like items are stacked.

4. Apparatus according to claim 3, further comprising extending and contracting means for reducing said partition plates and said holder means in length and for extending said partition plates and said holder means into their original lengths; moving means for moving said holder means along said partition plates; and retracting means for retracting said partition plates to positions located inwardly of an inner surface of said feeding and stacking means.

5. Apparatus according to claim 4, in which in the stacking mode, bottom surfaces of said stackers, which support leading edges of said sheet-like items charged into said stackers, are disposed substantially perpendicular to said partition plates, and in the feeding mode, said bottom surfaces of said stackers are disposed substantially horizontal.

6. Apparatus according to claim 3, in which said plurality of feeding and stacking means are vertically arranged one upon another.

7. Apparatus according to claim 6, in which an initial condition at a time of starting an operation is that a first feeding and stacking means of said plurality of feeding and stacking means, which is at the lowermost stage, is put into the feeding mode.

8. Apparatus according to claim 3, in which said feeding and stacking means are such that said plurality of stackers are serially arranged in contiguous relation to one another in a thicknesswise direction of said stacked sheet-like items.

9. Apparatus according to claim 3, in which one of said plurality of feeding and stacking means is put into the feeding mode while the other feeding and stacking means are put into the stacking mode, and said sheet-like items fed to said feeding and stacking means in the feeding mode are distributed and charged into said respective stackers of said feeding and stacking means in the stacking mode in accordance with sorting information.

10. Apparatus according to claim 3, in which sorting of said sheet-like items is repeatedly effected a plurality of times while switching said plurality of feeding and stacking means between the feeding mode and the stacking mode, thereby sequencing the fed said sheet-like items in an order of addresses.

11. Apparatus according to claim 3, further comprising singularizer means, singularizer moving means for moving said singularizer means to one of said plurality of feeding and stacking means which is in the feeding mode, and connection means for connecting said singularizer means and said conveying means together.

12. Apparatus according to claim 3, in which said sheet-like items are documents of mail, and said information comprises coded names and addresses, by which said documents are sorted in accordance with predetermined addresses.

13. In an apparatus for sorting sheet-like items such that an order of said sheet-like items is changed a plurality of times in accordance with information applied to said sheet-like items to thereby be sequenced in a desired order; said apparatus comprising:

a plurality of sorting shelves in which said sorting shelves comprise a plurality of stackers for stacking said sheet-like items therein, and, wherein said plurality of sorting shelves comprise at least first, second and third sorting shelves each having a stacking mode, in which said sheet-like items are distributed and charged into said respective stackers, and a feeding mode, in which said stacked sheet-like items are separated one by one to be discharged;

conveying means for conveying said sheet-like items between said sorting shelves while sorting said sheet-like items separated from one another into another sorting shelf;

reading means for reading information applied to said separated sheet-like items;

said conveying means for conveying said separated sheet-like items to another of said sorting shelves;

distributing means provided for each of said sorting shelves to distribute and charge the conveyed said sheet-like items into said respective stackers; and control means for controlling said conveying means and said distributing means, such that said first sorting shelf is put into the feeding mode, and when said sheet-like items stacked in said first sorting shelf are fed to said second and third sorting shelves in the stacking mode, said control means judges whether said information read by said reading means belongs to a first half or a second half of said information applied to said sheet-like items stacked in said first sorting shelf, and those ones of said sheet-like items having said first half of said information are conveyed to and sorted into said second sorting shelf while those ones of said sheet-like items having said second half of said information are conveyed to and sorted into said third sorting shelf, and thereafter sorting of said sheet-like items is repeated a plurality of times while changing the modes of said first and second sorting shelves, thereby sequencing those ones of said sheet-like items having said first half of said information, and thereafter sorting of said sheet-like items is repeated a plurality of times while changing the modes of said first and third sorting shelves, thereby sequencing those ones of said sheet-like items having said second half of said information.

14. Apparatus according to claim 13, in which said sheet-like items are divided into groups by partitioners in said sorting shelves and sorted by said sorting shelves, and said sorting shelves comprise means for retracting said partitioners.

15. Apparatus according to claim 14, in which there are three said sorting shelves.

16. Apparatus according to claim 13, in which said plurality of stackers are arranged in series in contiguous relation to one another in a thicknesswise direction of the stacked said sheet-like items, and further comprising singularizer means provided for each of said sorting shelves and disposed at one ends of said stacking means in the thicknesswise direction of said sheet-like items to separate said sheet-like items one by one.

17. Apparatus according to claim 13, in which said plurality of stackers are separated from one another by partition plates and serving to stack a subset of said sheet-like items therein in a generally upstanding position; and further comprising singularizer means for sequentially separating and taking out the sheets or the like conveyed by said conveying means; and mode changeover means for switching said sorting shelves between the stacking mode and the feeding mode.

* * * * *